US011280107B1

(12) United States Patent
Urhausen et al.

(10) Patent No.: US 11,280,107 B1
(45) Date of Patent: Mar. 22, 2022

(54) SHELTER AND HUB SYSTEM

(71) Applicant: DLX Enterprises, LLC, Eugene, OR (US)

(72) Inventors: Jonathan Urhausen, Eugene, OR (US); Adam Barr, Eugene, OR (US); Donald Bierman, Eugene, OR (US)

(73) Assignee: DLX Enterprises, LLC, Eugene, OR (US)

( * ) Notice: Subject to any disclaimer, the term of this patent is extended or adjusted under 35 U.S.C. 154(b) by 0 days.

(21) Appl. No.: 16/861,012

(22) Filed: Apr. 28, 2020

Related U.S. Application Data

(63) Continuation-in-part of application No. 16/431,322, filed on Jun. 4, 2019, now Pat. No. 10,941,559, which is a continuation of application No. 15/639,261, filed on Jun. 30, 2017, now Pat. No. 10,309,093.

(60) Provisional application No. 62/356,793, filed on Jun. 30, 2016.

(51) Int. Cl.

| | |
|---|---|
| ***E04H 15/18*** | (2006.01) |
| ***E04H 15/36*** | (2006.01) |
| ***E04H 15/46*** | (2006.01) |
| ***E04B 1/19*** | (2006.01) |
| ***E04H 15/50*** | (2006.01) |
| ***E04H 15/44*** | (2006.01) |

(52) U.S. Cl.
CPC ..... *E04H 15/18* (2013.01); *E04B 1/1903* (2013.01); *E04H 15/36* (2013.01); *E04H 15/44* (2013.01); *E04H 15/50* (2013.01); *E04B 2001/1927* (2013.01); *E04B 2001/1957* (2013.01)

(58) Field of Classification Search
CPC ..... E04H 15/18; E04H 15/36; E04H 15/44
USPC ..... 135/97, 124, 128, 131, 906, 908; 52/79.9, 79.5, 79.7, 79.8, 79.12, 86
See application file for complete search history.

(56) References Cited

U.S. PATENT DOCUMENTS

| | | | | |
|---|---|---|---|---|
| 3,559,353 | A * | 2/1971 | Partridge | E04B 1/3441 135/131 |
| 3,929,146 | A | 12/1975 | Maiken | |
| 3,955,328 | A * | 5/1976 | Lindsay | E04B 1/34846 52/73 |
| 4,373,305 | A * | 2/1983 | Russell | E04B 1/32 52/64 |
| 4,649,947 | A * | 3/1987 | Tury | E04H 15/18 135/117 |
| 4,658,560 | A | 4/1987 | Beaulieu | |

(Continued)

FOREIGN PATENT DOCUMENTS

| | | | | |
|---|---|---|---|---|
| CA | 2837116 | A1 * | 11/2012 | E04H 15/18 |
| DE | 29510827 | U1 * | 9/1995 | E04H 15/18 |

(Continued)

*Primary Examiner* — Robert Canfield
(74) *Attorney, Agent, or Firm* — MacCord Mason PLLC

(57) ABSTRACT

A shelter system is shown and described. A hub for a shelter system is shown and described. A frame for a shelter system is shown and described. In one embodiment, the shelter system includes a frame, a cover and a hub. The frame may be collapsible. The cover is configured to fit with the frame. The hub may include a receiver slot, a receiver sleeve and an attachment projection. The result is a shelter system with reduced set up time, effort and requirements and improved strength and ease of use. The inventions may also be considered a shelter kit and/or a shelter and hub method.

17 Claims, 30 Drawing Sheets

(56) References Cited

U.S. PATENT DOCUMENTS 4,689,932 A * 9/1987 Zeigler ..... E04B 1/3211 52/653.1
4,706,696 A 11/1987 Gillis
4,846,204 A 7/1989 Sok Kyu
4,886,084 A * 12/1989 Lawrence ..... E04H 15/18 135/124
4,945,936 A 8/1990 Surrendi
4,953,329 A * 9/1990 Frantl ..... E04B 1/3205 52/80.1
4,995,212 A 2/1991 Morgan
5,017,068 A 5/1991 Cooksey
5,069,572 A 12/1991 Niksic
5,159,948 A * 11/1992 Moreau ..... E04H 15/18 135/125
5,394,897 A * 3/1995 Ritchey ..... E04H 15/18 135/117
5,634,483 A 6/1997 Gwin
5,666,986 A 9/1997 Fox
5,943,837 A 8/1999 Esser
6,141,934 A * 11/2000 Zeigler ..... E04H 15/50 135/121
6,145,525 A * 11/2000 Mooney ..... E04H 5/02 135/119
6,223,482 B1 5/2001 Zahar
D454,609 S 3/2002 Meyerhoffer et al.
6,553,698 B1 4/2003 Kemeny
6,553,699 B2 4/2003 Kemeny
6,758,354 B2 7/2004 Carletti
6,772,780 B2 8/2004 Price
6,802,329 B2 10/2004 Chen
7,131,236 B2 11/2006 Sample
D544,941 S 6/2007 Rogers
7,533,498 B2 * 5/2009 Zeigler ..... E04B 1/3205 135/128
7,556,054 B2 7/2009 Zeigler
8,082,938 B2 * 12/2011 Prusmack ..... E04B 1/3441 135/135
D652,885 S * 1/2012 Frey ..... D21/834
8,360,085 B2 1/2013 Lee
8,381,454 B1 * 2/2013 Robinson ..... E04H 1/1211 52/79.5
8,448,656 B2 5/2013 Choi
8,496,019 B2 7/2013 Zhou
8,925,565 B2 1/2015 Choi
9,103,137 B2 * 8/2015 Williams ..... E04H 15/06
9,163,425 B1 10/2015 Kubica
9,243,423 B2 1/2016 Jin
9,243,424 B2 1/2016 Jin
9,470,010 B2 * 10/2016 Youn ..... E04H 15/18
9,605,441 B2 3/2017 Choi
9,631,393 B2 4/2017 Zeigler
9,714,523 B2 * 7/2017 Lilly, II ..... E04H 15/64
9,752,345 B1 * 9/2017 LaHood ..... E04H 15/30
9,869,110 B2 * 1/2018 Krenzel ..... E04H 15/50
10,060,151 B2 * 8/2018 Krenzel ..... E04H 15/40
10,309,093 B1 6/2019 Urhausen et al.
10,858,856 B1 * 12/2020 Dusek ..... E04H 15/36
10,995,516 B2 * 5/2021 Ribner ..... E04H 15/50
2004/0173252 A1 * 9/2004 Bouchard ..... E04H 15/50 135/131
2005/0189009 A1 * 9/2005 Walter ..... E04H 15/32 135/97
2005/0204680 A1 * 9/2005 Zeigler ..... E04H 15/50 52/646
2005/0204681 A1 * 9/2005 Zeigler ..... E04H 15/50 52/646
2006/0260666 A1 11/2006 Choi
2006/0283103 A1 * 12/2006 Chen ..... E04H 15/18 52/63
2007/0039639 A1 * 2/2007 Duncan ..... E04H 9/10 135/97
2007/0051399 A1 3/2007 Jung
2007/0084493 A1 * 4/2007 Prusmack ..... E04H 15/18 135/135
2007/0125410 A1 * 6/2007 Williams ..... E04H 15/36 135/136
2008/0017232 A1 * 1/2008 Zeigler ..... E04H 15/50 135/131
2008/0017233 A1 * 1/2008 Zeigler ..... E04H 15/50 135/145
2008/0264462 A1 * 10/2008 Rottmann ..... E04H 15/18 135/123
2010/0170162 A1 * 7/2010 Pfeiffer ..... E04H 15/008 52/2.24
2012/0090455 A1 * 4/2012 Duncan ..... E04H 15/18 89/36.07
2013/0008478 A1 1/2013 Prieto Estebanez
2014/0182643 A1 7/2014 Yang
2015/0167343 A1 6/2015 Fang
2015/0240513 A1 8/2015 Fang
2017/0247906 A1 * 8/2017 Zeigler ..... E04H 15/50
2018/0155952 A1 6/2018 Robert
2020/0190844 A1 * 6/2020 Ribner ..... E04H 15/50

FOREIGN PATENT DOCUMENTS

DE 29517290 U1 * 12/1995 ..... E04H 15/36
DE 29716289 U1 * 10/1997 ..... E04H 15/18
FR 2705718 A1 * 12/1994 ..... E04H 15/18
FR 2997984 A1 * 5/2014 ..... E04H 15/18

* cited by examiner

SHELTER AND HUB SYSTEM

This application is a continuation-in-part of application Ser. No. 16/431,322, filed Jun. 4, 2019, which is a continuation of application Ser. No. 15/639,261, filed Jun. 30, 2017, now U.S. Pat. No. 10,309,093, which claims benefit of provisional 62/356,793, filed Jun. 30, 2016.

FIELD OF THE TECHNOLOGY

The present disclosure relates generally to shelters and hub systems for shelters, and more particularly to an improved hub system, apparatus, kit and methods, for example, for deployable shelter assemblies.

BACKGROUND

Deployable shelters, tents, rapid-deployment shelters, forts and the like typically include sheets of fabric, or other materials, secured to a frame. Often these units are free-standing or are similarly semi-attached to a ground surface or tangential fixture. In some instances, guy ropes help anchor the unit to a ground surface once the shelter is assembled. Rapid deployment and assembly of such a shelter is often a difficult and demanding task, particularly during emergency situations and in uncertain environmental conditions.

For instance, rapid tactical shelters are used in a variety of demanding on-site scenarios including fire, incident command, communication areas, crime scene investigation, flu vaccination, military deployment, temporary hospital, and other on-site emergency response spots in a variety of challenging terrains, and environmental conditions. Rapid deployment, with quick and easy set-up and take-down of such units is often beneficial, if not necessary. Deployment situations may be, for example, in extreme heat or cold, during on-going emergencies and in remote locations, making ease of assembly extremely important and transportation of weighted items impractical. Durability of items in such terrain and environmental situations can also be a challenge. Incremental changes to weight, cost, ease of assembly and durability of deployable shelters and related shelter systems can result in large improvements in the field.

Therefore, Applicants desire improved systems, kits, assemblies, apparatus and methods for shelter and hub systems for deployment shelters and it is toward these and other challenges the present disclosure is directed.

SUMMARY

In accordance with the present disclosure, hub systems and improved shelter systems and assemblies are provided for deployment of shelters, forts deployment tents and the like. This disclosure provides an improved hub system that is convenient, efficient, easily portable, reliable, durable, and quick for the user, particularly when used in conjunction with other accessories often used in deployment shelters, for example HVAC, lighting, power cords, interior insulation, etc.

In one embodiment of the present disclosure, a hub for assembly of a shelter may include at least one receiver slot, a receiver sleeve, and at least one attachment point. Other embodiments may be considered a hub for assembly of a rapid-deployment shelter. The hub may include, in some examples, a set of receiver slots, a receiver sleeve and a set of attachment projections. The receiver slot may include two parallel slot walls, a slot floor and a center slot wall. The receiver sleeve may be medially positioned to the receiver slots. The set of attachment projections may be rounded or may take on other shapes. The set of attachment projections may be attached at each end to a slot wall.

In some embodiments, a receiver sleeve may include an inner receiver and an outer receiver. The inner receiver and outer receiver may form a pressure lock system. The inner receiver and outer receiver walls may be angled. The angle may, for example, be between about 0.001 and 1 degrees, or is contemplated to also be more. In some examples, the taper may be at 0.5 degrees. The inner receiver may be angled inwardly from the floor. The outer receiver may be angled outwardly from the floor. In some examples, the taper of the angle of the outer receiver may be opposite that of the taper of the angle of the inner receiver.

Some examples of frame and hub assemblies include a set of hubs and a set of frame poles. In some examples, the frame and hub assembly may include variations of the hub, for example, partial hubs, by way of example, for corners of the frame assembly. Embodiments may include methods for assembly of the frame and hub assembly in which the frame poles are connected through the hubs. In some examples, a hub may be placed and oriented top down, bottom down and/or on a hub side to form the frame and hub assembly. There may be a portion of the hubs horizontally oriented in connecting the hubs and a portion of the hubs vertically oriented in the frame and hub assembly. There may be partial hubs included in the frame and hub assembly. Partial hubs may be specialized to accept frame poles in hard to fit positions, for example, in frame and hub assembly corners and/or long frame pole articulations.

In still other examples, the inventions of the present disclosure may be considered a frame for an emergency, rapid-deployment shelter system. The frame may include a set of hubs and a set of frame poles, a portion of the frame poles secured with a portion of the hubs to form a skeleton frame for a rapid-deployment shelter system. The rapid-deployment shelter system may include more than one shelter. The rapid-deployment shelter system may include more than one shelter mated with other rapid-deployment shelters. A shelter hub may interconnect more than one rapid-deployment shelter.

Other embodiments may be considered a shelter system including a frame, a cover and at least one hub. The frame may include a plurality of interconnected frame poles. The frame poles may be configured to alternate between a first extended position and a second retracted position. The cover may be configured to mate with the frame and/or be secured to the frame. The hub may include a set of receiver slots, a receiver sleeve, and a set of attachment projections.

In other examples the inventions disclosed may be considered hub and shelter methods, for example a method for a hub, a method for a shelter system kit, a method for an improved shelter and a method for rapid deployment of a shelter according to the disclosure.

The above summary was intended to summarize certain embodiments of the present disclosure. Embodiments will be set forth in more detail in the figures and description of embodiments below. It will be apparent, however, that the description of embodiments is not intended to limit the inventions of the present disclosure, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
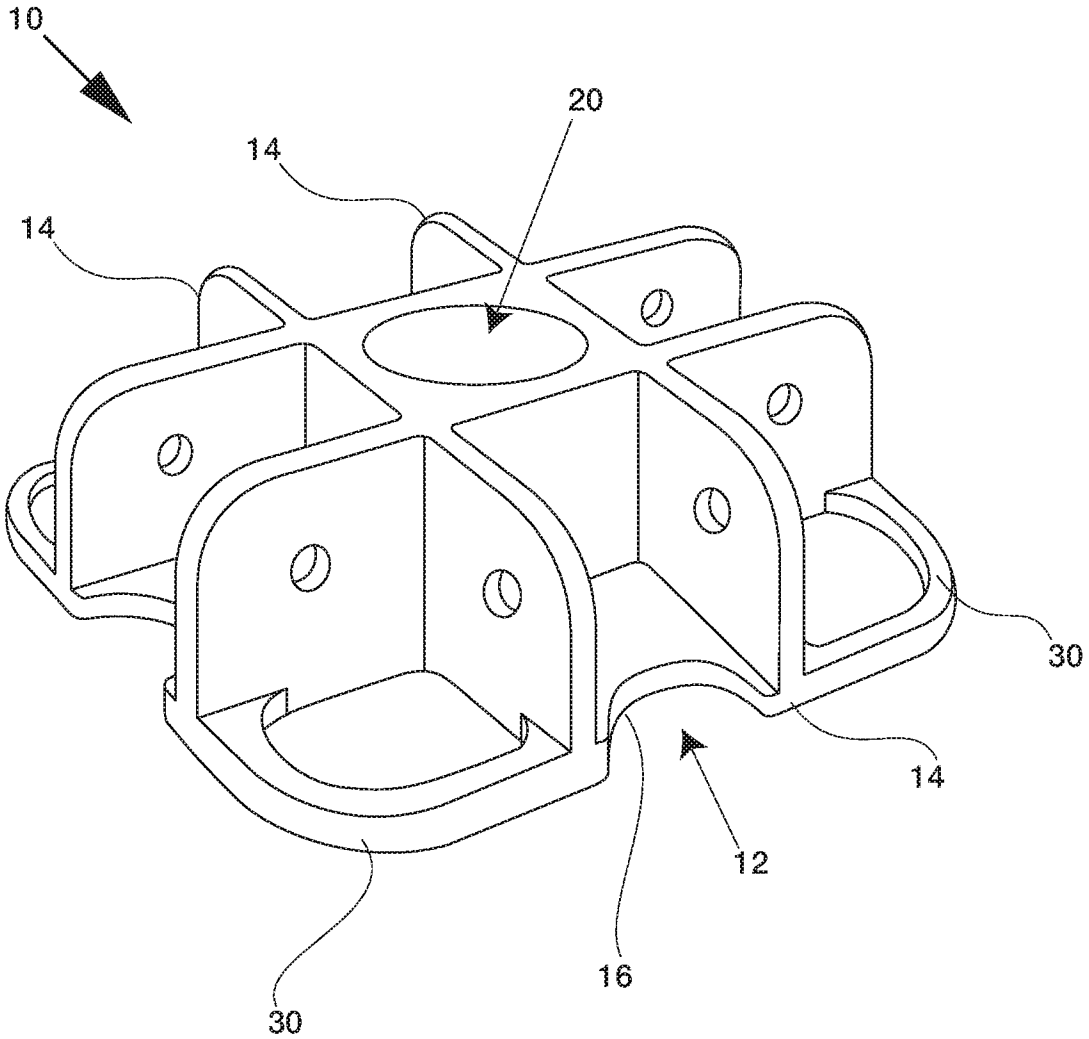
FIG. 1 is a side perspective view of one example of a hub for a deployment shelter according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general, it will be understood that the illustrations are for the purpose of describing embodiments of the disclosure and are not intended to limit the disclosure or any invention thereto. Collapsible shelters generally have a short lifespan as they expand and then collapse into a carryable form repetitively and generally are thrown about to experience a significant amount of wear and tear. These types of shelters are often thought of as readily replaceable and priced accordingly. Rapid deployment shelters, however, are much more significant purchases and are used under extreme conditions in emergency deployments, precarious weather situations, in remote locations and are expected for function seamlessly with higher expectations in repetitive deployments. Applicant realizes that durability, strength and weight associated with rapid deployment shelters are extreme challenges and can all be limiting factors. It is to these and other challenges that Applicant's improved hub and shelter system is directed.

FIG. 1 shows a side view of one example of a hub 10 for a shelter according to an embodiment of the disclosure. A hub 10 for assembly of a shelter may include at least one receiver slot 12, a receiver sleeve 20, and at least one attachment projection 30. In some examples, at least a portion of the hub 10 is made of glass filled nylon and in other examples; the hub 10 may be entirely made of glass filled nylon. Applicant realized that formulating the hub 10 out of glass filled nylon, for example instead of the traditional metal, could give the hub slightly more flexibility than a metal hub, however, strength and durability were concerns. Applicant's hub 10 may exclude metal parts.

Figure 2:
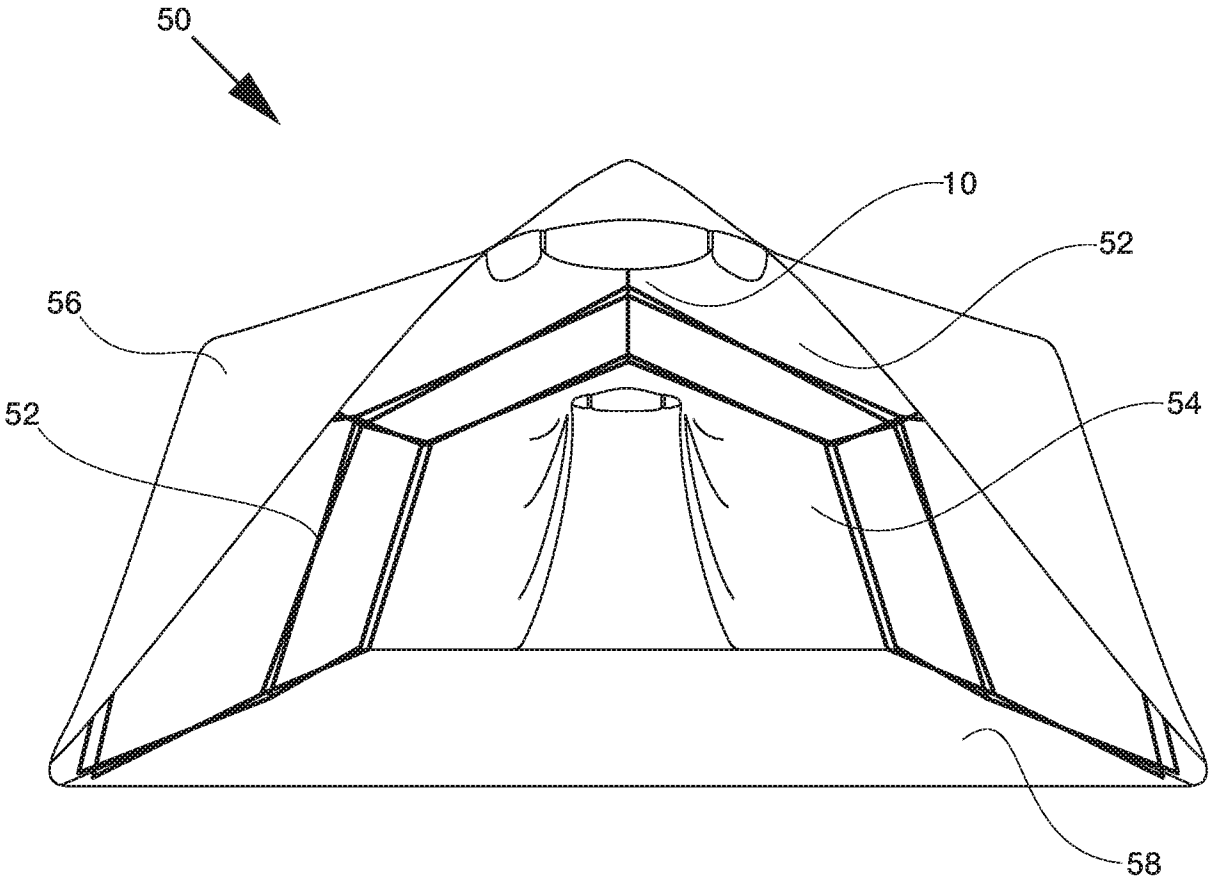
FIG. 2 is a front view of a one example of a deployment shelter with a hub system according to an embodiment of the disclosure.
Figure 3:
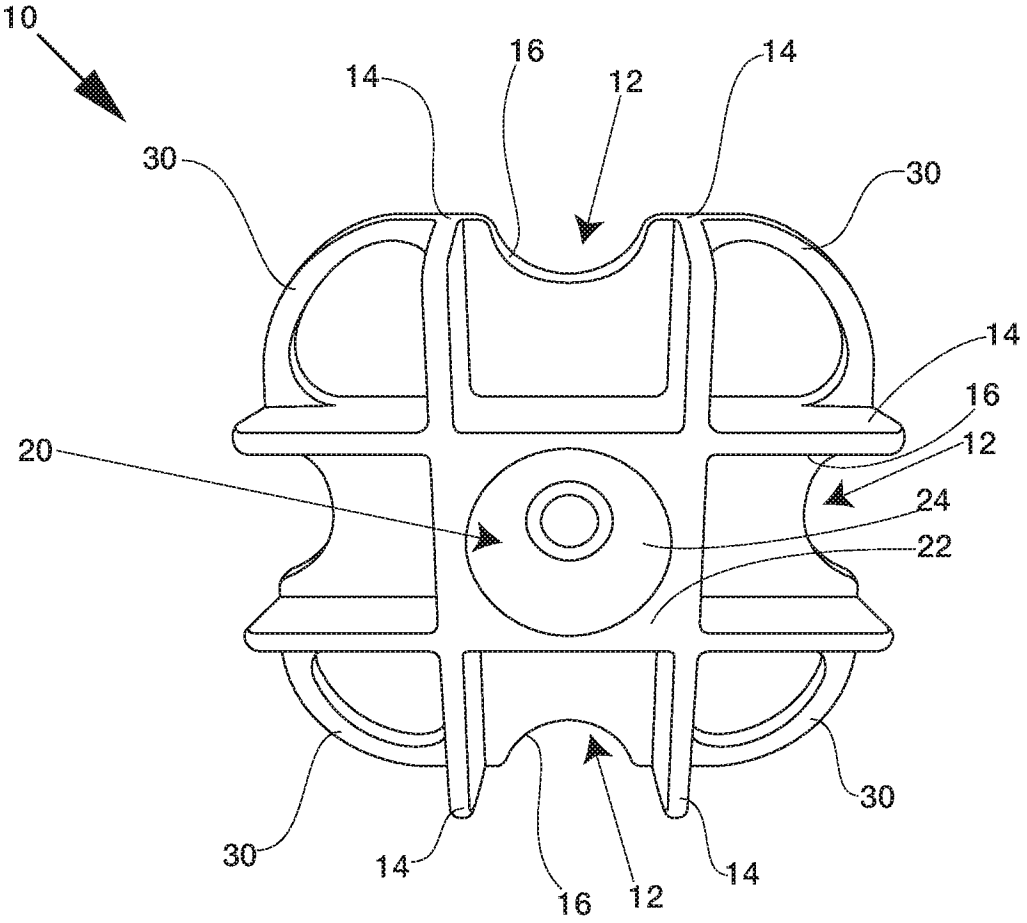
FIG. 3 is a top view of one example of a hub according to the present disclosure.
Figure 4:
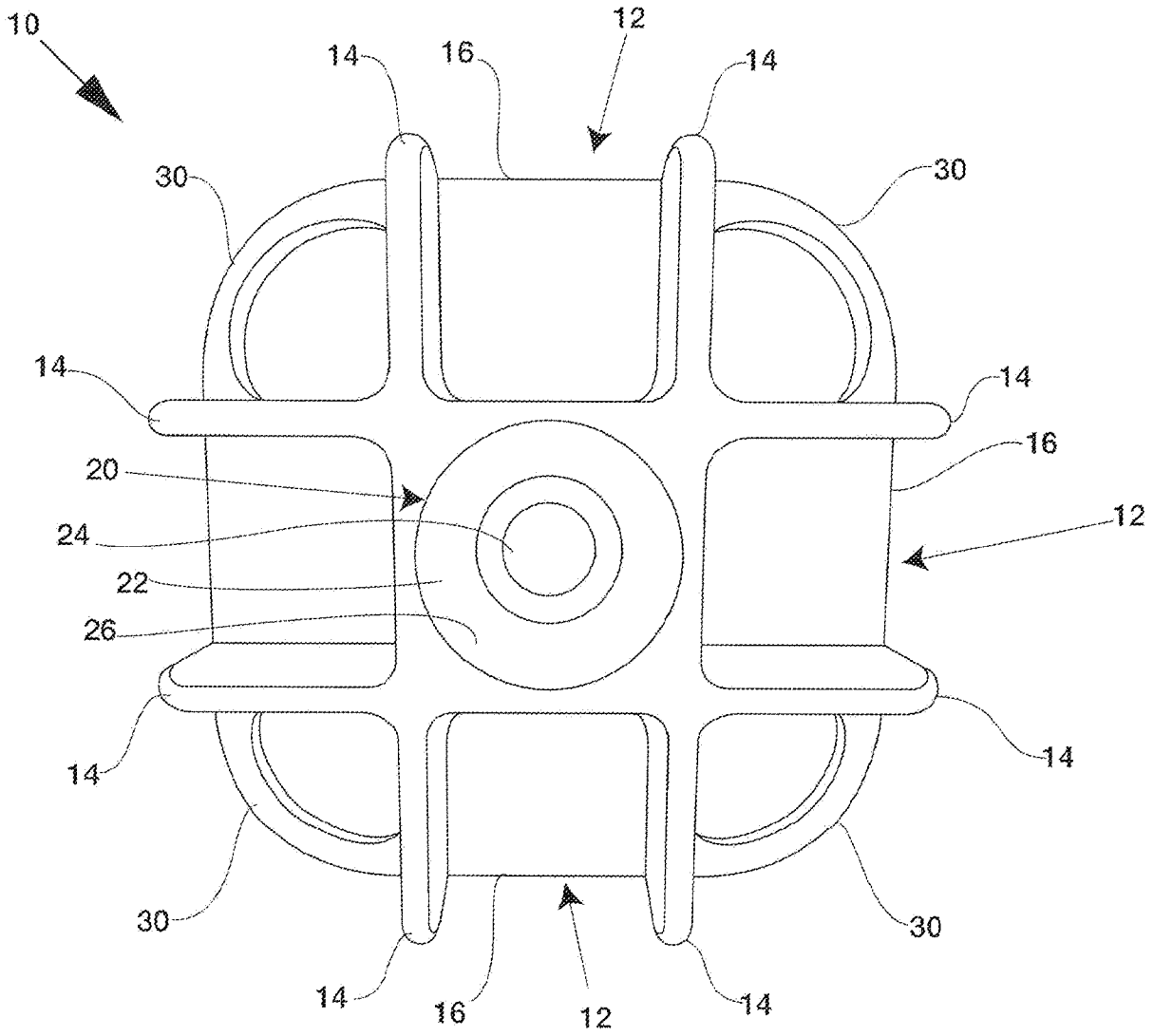
FIG. 4 is a top view of one example of a hub according to the embodiment of FIG. 1.

One or more hubs 10 may make up a hub system for a deployment shelter 50, as seen in FIG. 2. An articulating frame system of frame poles 52 may mate with, provide a skeleton frame for, a shelter cover. Shelter covers are often made of a fabric or canvas material that may be torn or ripped during contact with traditional frames, especially those with metal parts and assemblies. Applicant's hub reduces the chances of wear and tear on both the frame and the cover of the shelter. In many cases, when a shelter is expanded, a cover is required to be secured to the frame by way of an attachment strap with an attachment buckle that expands between the cover and the hub. The need for such attachment straps have been eliminated with Applicant's improved hub, in one example, by the hub pressure lock structure, described in more detail later. In some examples, however, attachment straps and/or buckles may be desired and are considered with the scope of the inventions of the disclosure.

Any of the shelters 50 shown or described herein may include a variety of field deployment elements. For instance, the shelter may be light weight for easy carry transport and may include an articulated frame, robust coverings/canopy 56 and canopy features, flooring 58, floor liner, door ends 59 and openings 53, lighting features, power features, electrical supply, lighting, liners 65, bedding, bunk bedding, tables, shelter identification tags, emergency response equipment, and additional water features and water bladders, anchor weights, and sand bags. The shelters may be any size and multiple shelters may be joined through door openings 53 and/or door ends 59 to create scalable complexes with the advantages of the inventions herein. Joined shelters may be considered shelter systems 170 including more than one shelter joined at a matched face 100 and include any of the embodiments and features included in the present disclosure. Some shelters 50 may serve as a shelter hub 150 and include scalability of connectivity between two or more shelters.

Particular shelter examples include, but are not limited thereto, a unit with floor space of about fifteen feet by twelve feet and an area of about one hundred and height square feet; a unit with floor space of fifteen feet by eighteen feet and an area of about two hundred and seventy feet; and a variety of other sizes.

In other embodiments, the disclosure includes a shelter kit. In this embodiment, the kit may comprise at least one shelter 50, e.g. any of the shelters and/or shelter accessories shown or described, and a plurality of hubs 10, e.g. any of the hub embodiments shown or described.

Other embodiments, seen throughout FIGS. 3-8, may be considered a hub 10 for assembly of a rapid-deployment shelter 50. The hub may include, in some examples, a set of receiver slots 12, a receiver sleeve 20 and a set of attachment projections 30. The receiver slot 12 may include slot walls 14, a slot floor 16 and a center slot wall. The receiver sleeve 20 may be medially positioned to the receiver slots 12. The set of attachment projections 30 may be rounded or may take on other shapes. The set of attachment projections 30 may be attached at each end to a slot wall 14. In some examples, an attachment area 29 may be formed between two slots. The attachment area 29 may have one side forming a substantially right angle, formed by the intersection of two receiver slot walls. Opposite the attachment area side having a substantially right angle, the area 29 may include a rounded surface. An attachment projection 30 may be cornered between two receiver slots 12.

The receiver slot 12 may include a first slot wall 14 and a second slot wall 14, positioned such that the two slot walls are substantially parallel, and each attached to a slot center wall and a slot floor 16. In some examples, a slot wall 14 of one receiver slot 12 is substantially perpendicular to the slot wall 14 of an adjacent receiver slot 14.

In some embodiments, receiver sleeve 20 may include an inner receiver 24 and an outer receiver 22 and a sleeve bottom 26. The inner receiver 24 and outer receiver 22 may form a pressure lock system. The inner receiver 24 and outer receiver 22 walls may be angled. The angle may, for example, be between about 0.001 and 1 degrees, or is contemplated to also be more. The inner receiver 24 may be angled inwardly from the floor. The outer receiver 22 may be angled outwardly from the floor. The inner receiver 24 and outer receiver 22 walls may be angled away from each other at the top of the receiver 20 and toward each other toward the floor of receiver 20. The angled inner receiver 24 wall and the angled outer receiver wall 22 may form a pressure lock system for accepting a frame pole 52, for example and specifically a spacer pole 51, and securing the pole with the hub 10.

Figure 9:
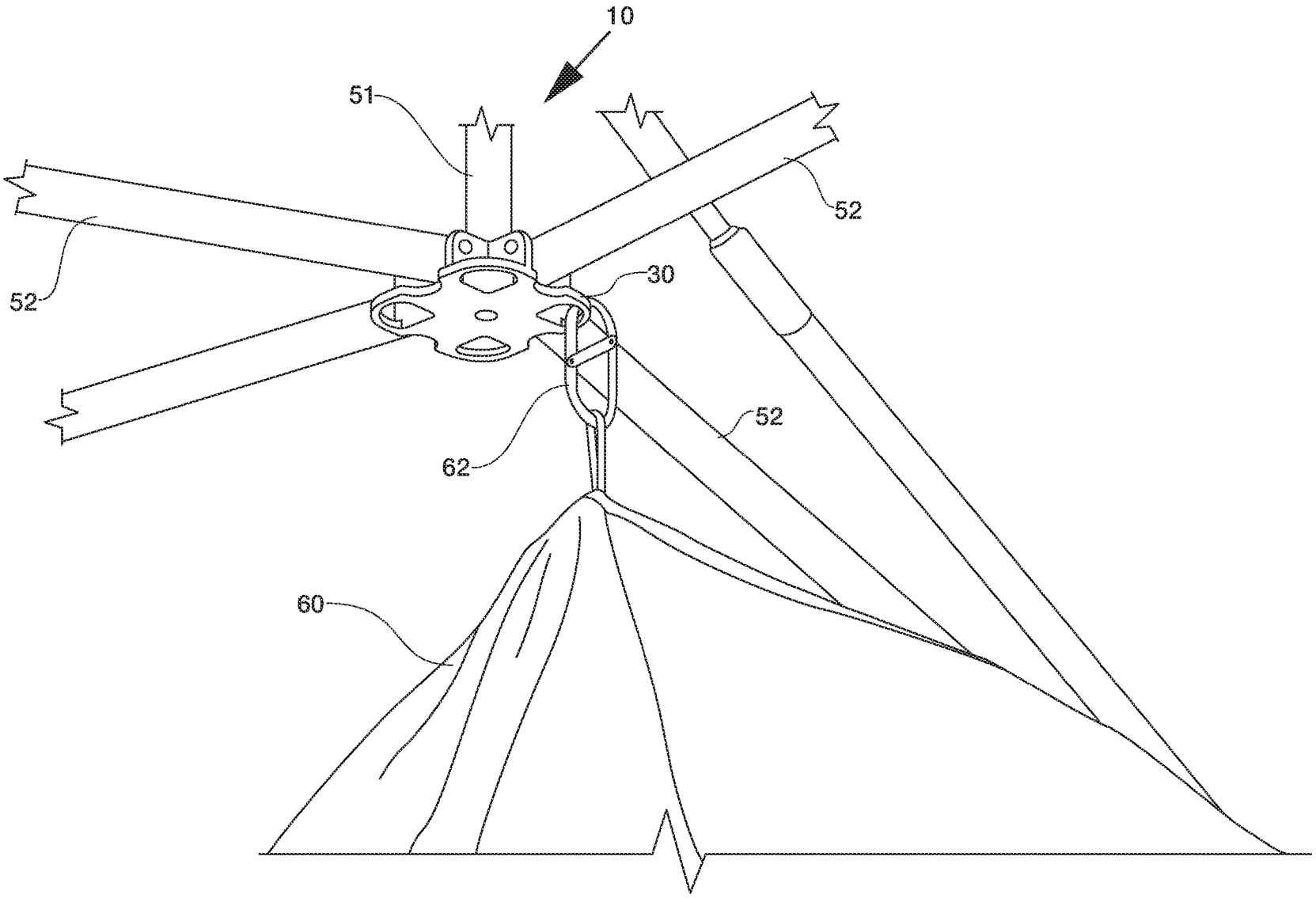
FIG. 9 is a perspective view of another example of a portion of a hub assembly of a hub system, according to the present disclosure.
Figure 10:
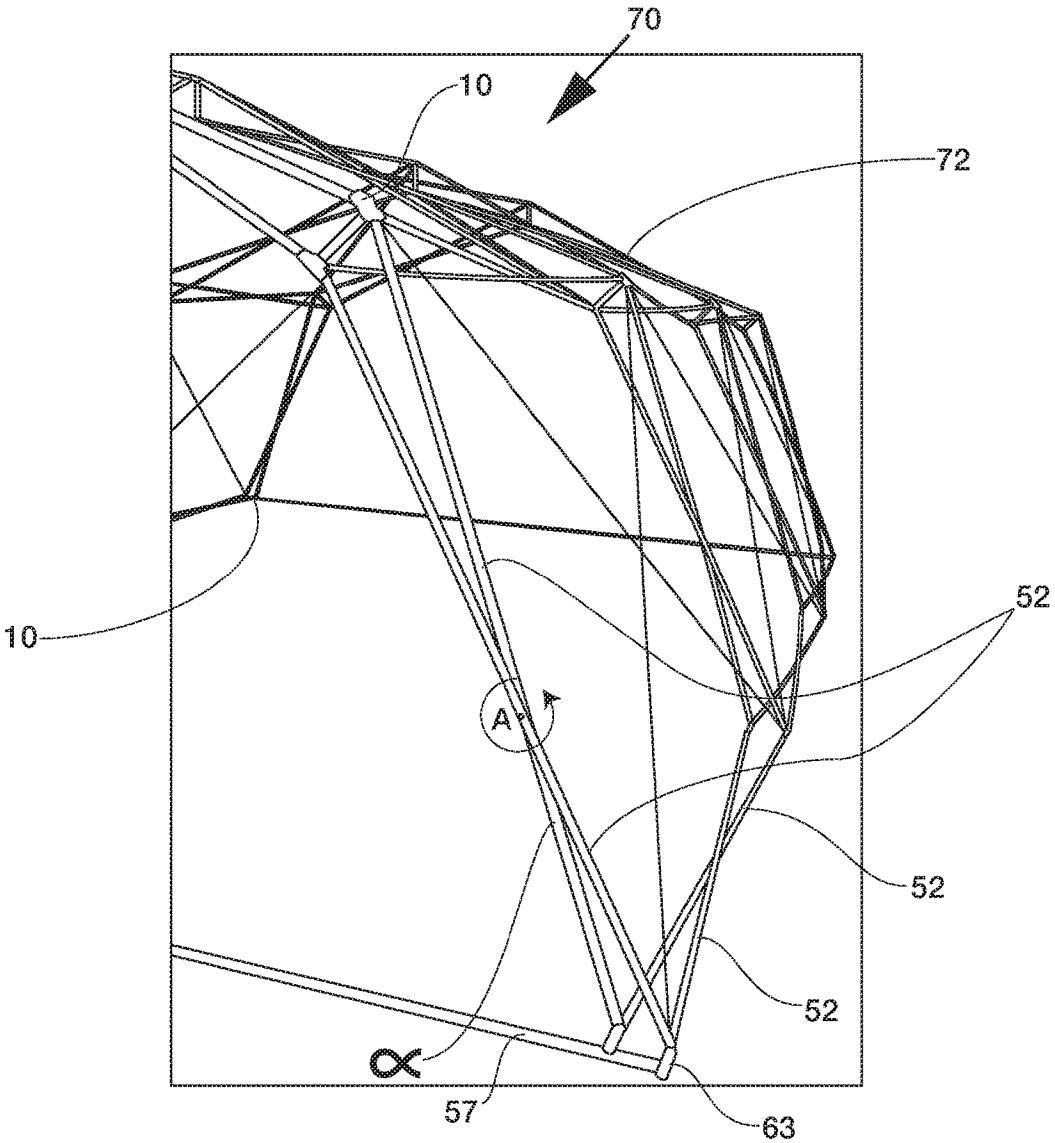
FIG. 10 is a perspective view of one example of a frame and hub assembly of the rapid-deployment frame and shelter system, according to FIG. 2.

Attachment projections 30 may be attached on one end to a slot wall 14 that is perpendicular to the slot wall 14 attached to the other attachment projection end. Attachment projections may be curved, rounded or take on any other applicable shape. Many shelter accessories 60 (see FIG. 9) are utilized with rapid deployment shelters, as previously discussed, and these items often need to be attached or secured with the shelter. Such items as HVAC components and insulation sheets can be heavy and place a large weight load on the shelter, especially the shelter frame, and there is traditionally not a good place to attach such items. Applicant's hub system includes attachment projections 30 and a pin system 80 that collectively simplify assembly of the shelter and also provide unique attachment options for accessory items and attachments, without compromising the frame and shelter integrity and without increasing shelter carry weight. Attachment projections 30 secure attachment objects to the frame securely so that the attachment objections do not move along the frame. In some examples, the rounded outer side of projections 30 presents a curved surface for contact with the shelter canopy and other accessory items, preventing wear and tearing that may occur with a non-rounded surface.

The attachment projections 30 are configured to allow shelter accessory 60 attachment with accessory attachments 60.

The hub weight, in some examples, may be less than or equal to about 1.75 oz. The hub weight in other examples may be between about 1.25 oz. to about 1.75 oz. The hub may be at least about 4 mm thick. The hub may be at least about 5 mm thick in other examples. Applicant was able to realize a reduced hub weight of over 40% of that of conventional hubs, while increasing the strength and durability of the hub 10.

In some embodiments, attachment projections 30 may be about 0.20 to about 0.260 inches in thickness. The attachment projections 30 may be at least 0.250 inches in thickness. The hub base, flooring between the slot walls 14, may be substantially between 0.150 inches to about 0.200 inches in thickness. The hub base may be at least 0.200 inches in thickness in some examples.

Applicant conducted vertical break testing for the hub to simulate the weight that is often supported from a hanging position on attachment points for rapid deployment shelters by accessory and attachment items. Weight was applied to the hub in increments and increased until vertical break was detected. Applicant desired attachment points with low weight, ease of access, durability and strength. In some examples, hub 10 and the attachment projections 30 may have an average vertical break of above 125 lbs., 145 lbs. or 155 lbs. In some examples, the vertical break may be between about 145 lbs. and about 170 lbs.

Applicant conducted lateral break testing to simulate the side pull that is may be withstood from a side load position. Again, Applicant desired attachment points with low weight, ease of access, durability and strength. Weight was again applied to the hub in increments until vertical break was detected. In some examples, the hub 10 and attachment projections 30 may have an average lateral break of above 150 lbs., 160 lbs., or 170 lbs. In some examples, the lateral break may be between 150 lbs. and about 200 lbs.

Other embodiments may be considered a shelter system 70 including a frame 72, a cover/canopy 56 and at least one hub 10. The frame 72 may include a plurality of interconnected frame poles 52. The frame may include a connector 57. The connector 57 may span between the front right and front left corners of the frame. The connector 57 may also span between the back left and back right corners of the frame. The connectors may be frame poles 52, straps, elastic, nylon or any other suitable material. The connectors may stabilize the frame. The connectors may be a set of connectors joined end to end. The connectors may be frame base connectors. The frame poles 52 may be configured to alternate between a first extended position and a second retracted position. The retracted positon may include just the frame poles 52 in a retracted position, the frame poles 52 and the hubs 10 in a retracted position, and/or the frame poles 52, hubs 10 and the canopy 56 in a retracted position, assembled and/or unassembled for storage and transport. The entire shelter system may fully retract in a second position and fully expand without assembly into a first deployed position. The cover 56 may be configured to mate with the frame 72 and/or be secured to the frame or may be already mated with the frame. The hub 10 may include a set of receiver slots 12, a receiver sleeve 20, and a set of attachment projections 30.

Figure 5:
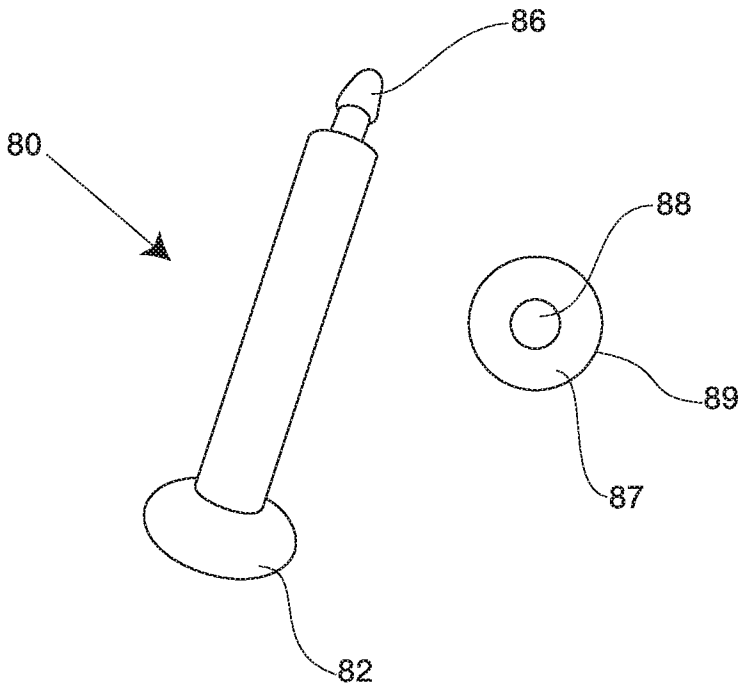
FIG. 5 is a side perspective view of one example of a pin and a washer element of the hub system.
Figure 6:
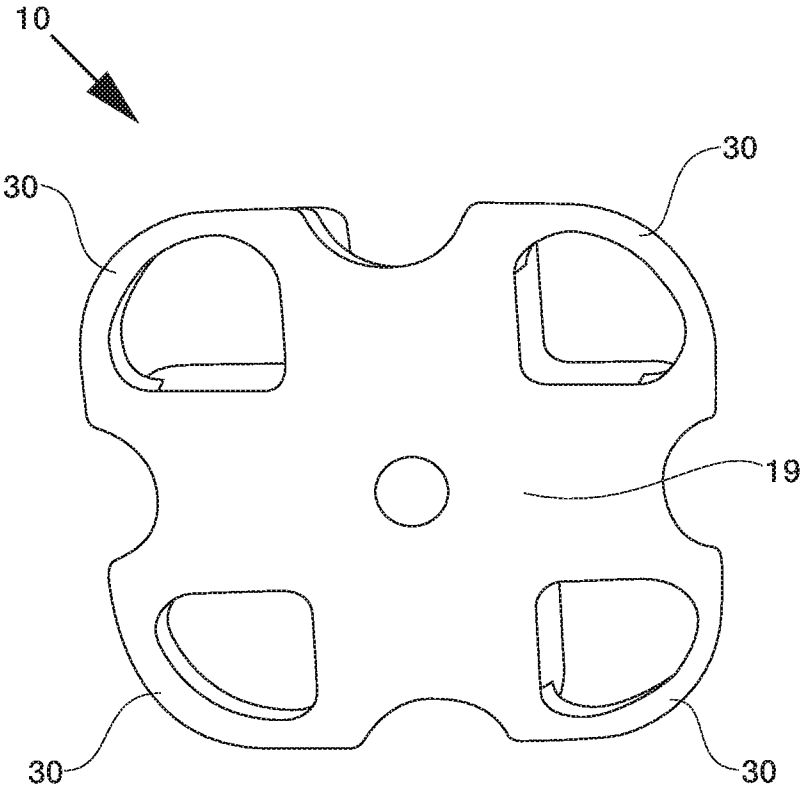
FIG. 6 is another example of a bottom view of a hub according to the present disclosure.
Figure 7:
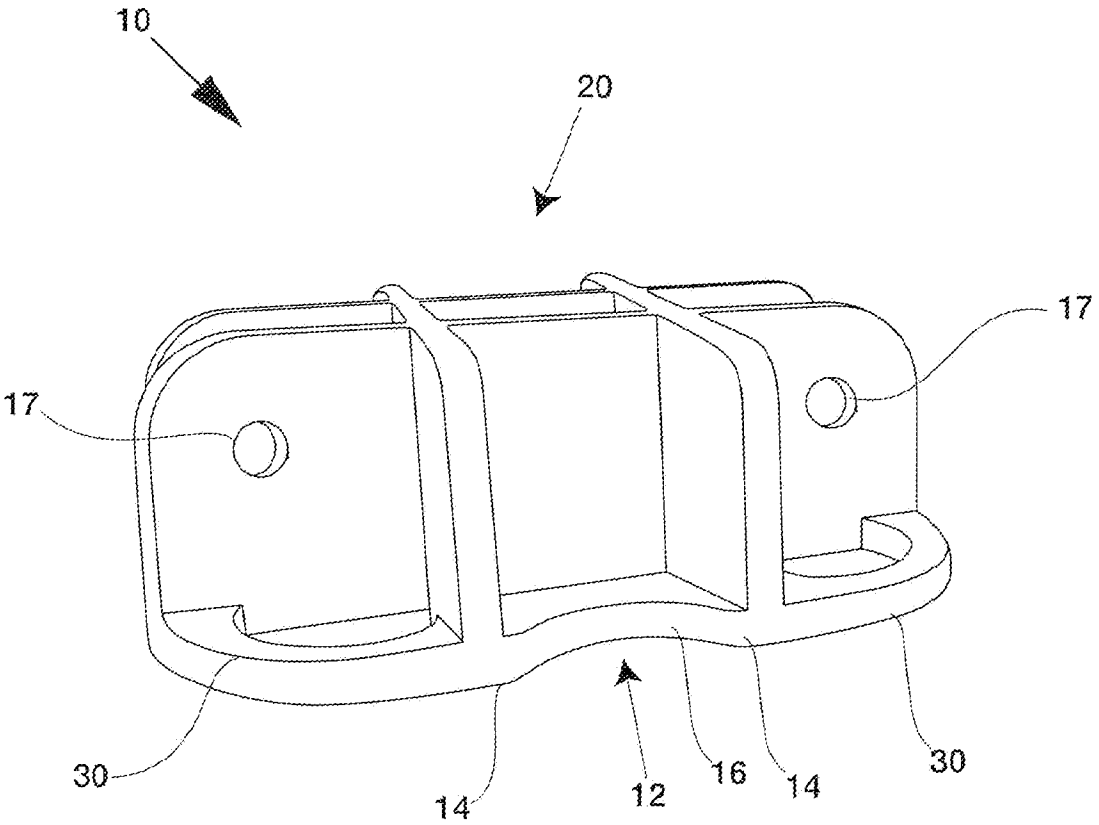
FIG. 7 is a side perspective view of one example of a hub according to the embodiment of FIG. 1.
Figure 8:
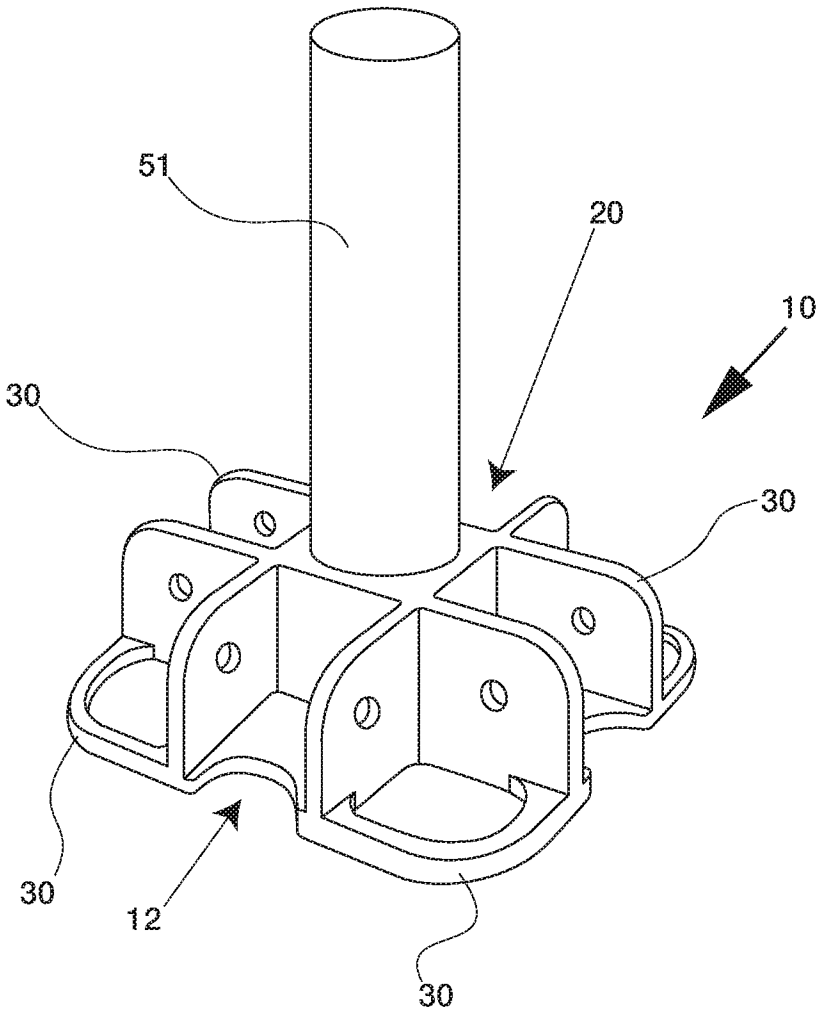
FIG. 8 is a side perspective view of one example of a portion of a hub assembly of a hub system according to the present disclosure.

In some embodiments the pin system 80 may include a plurality of pins and matched washers. Applicant's pin system, as seen in FIGS. 5 and 7, may fit through slot openings 17 on slot receiver walls 14 to secure in place attachments and/or frame poles 52. Once a frame pole 52 is mated with a hub 10, the pole 52 may be secured movably to the hub 10 with a pin system 80 with a washer 89 and pin 86. Applicant's articulating frame poles 52 and configuration may include openings that accommodate and match with the openings 17 and the pin system 80. By way of example, the pin 86 and washer 89 may be made of glass filled nylon able to remain durable and also light weight and easy to repeatedly remove and replace into position. In this example, the pin 86 is configured to slide through the hub and tubes of the frame and to mate with its mated washer that is configured to pop over the end of the pin to lock tight. Conventionally, metal pins with split rings have been utilized with shelters, with the split rings being difficult to remove and assemble quickly and extremely difficult to replace in the field. Applicant's pin system increases ease of assembly and removal, maintains strength and decreases weight load. Applicant's pin system is economical, durable and reduces the time for assembly and/or repair of the shelter system.

FIGS. 10-14 show examples of a shelter system, one example including frame and hub assemblies, 70. A frame and hub assembly may include a set of hubs 10 and a set of frame poles 72. In some examples, the frame and hub assembly may include variations of the hub, for example, partial hubs 63, by way of example, for corners of the frame assembly. Embodiments may include methods for assembly of the frame and hub assembly in which the frame poles are connected through the hubs. In some examples, a hub may be placed and oriented top down, bottom down and/or on a hub side (seen in FIG. 12) to form the frame and hub assembly. There may be a portion of the hubs horizontally oriented in connecting the frame poles and a portion of the hubs vertically oriented in the frame and hub assembly. There may be partial hubs included in the frame and hub assembly. Partial hubs 63 may be specialized to accept frame poles in particular hard to fit positions, for example, in frame and hub assembly corners and/or long frame pole articulations.

In still other examples, the inventions of the present disclosure may be considered a shelter and frame for an emergency, rapid-deployment shelter system. The frame may include a set of hubs 10 and a set of frame poles 52, at least a portion of the frame poles secured with a portion of the hubs to form a skeleton frame for a rapid-deployment shelter system. The shelter and frame for an emergency, rapid-deployment shelter system fully assembled and movable between a first deployed position and a second retractable position. In the retracted position, the canopy, 56, frame poles 72 and hubs 10 may stay substantially attached with the frame poles 72 collapsing parallel and next to each other. The frame poles 72 may be internal poles, external poles and ceiling poles. Frame poles 72 may, for example, be in pairs 77. The poles in pairs may be connected at about a center point and the poles may retract to be parallel in the same plane. The poles in pairs may be connected at about a center point and the poles may rotate about an axis A (FIG. 10, 13) at the connected point to diverge at their ends away from each other. The connected poles may diverge at an angle alpha. The angle alpha may be about 1 to less than 90 degree. The angle alpha may, by way of example, be about 5 to about 25 degrees.

Figure 11:
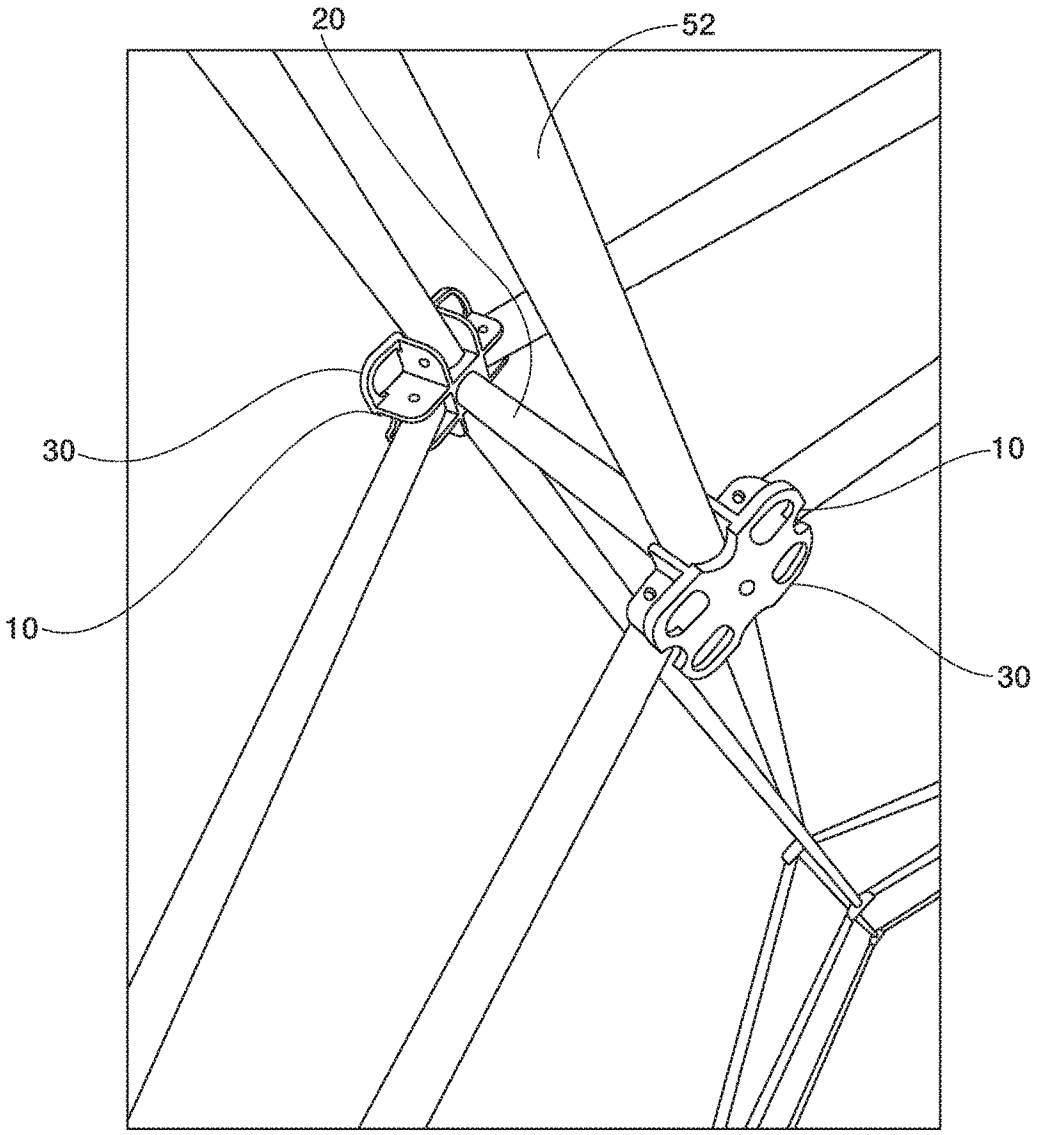
FIG. 11 is a close-up view of one example of the frame and hub assembly according to FIG. 10.

As seen in FIG. 11, the frame poles 52 may link with the hubs 10 to form frame 72. Attachment projections 30 are configured to accept attachment items.

Figure 12:
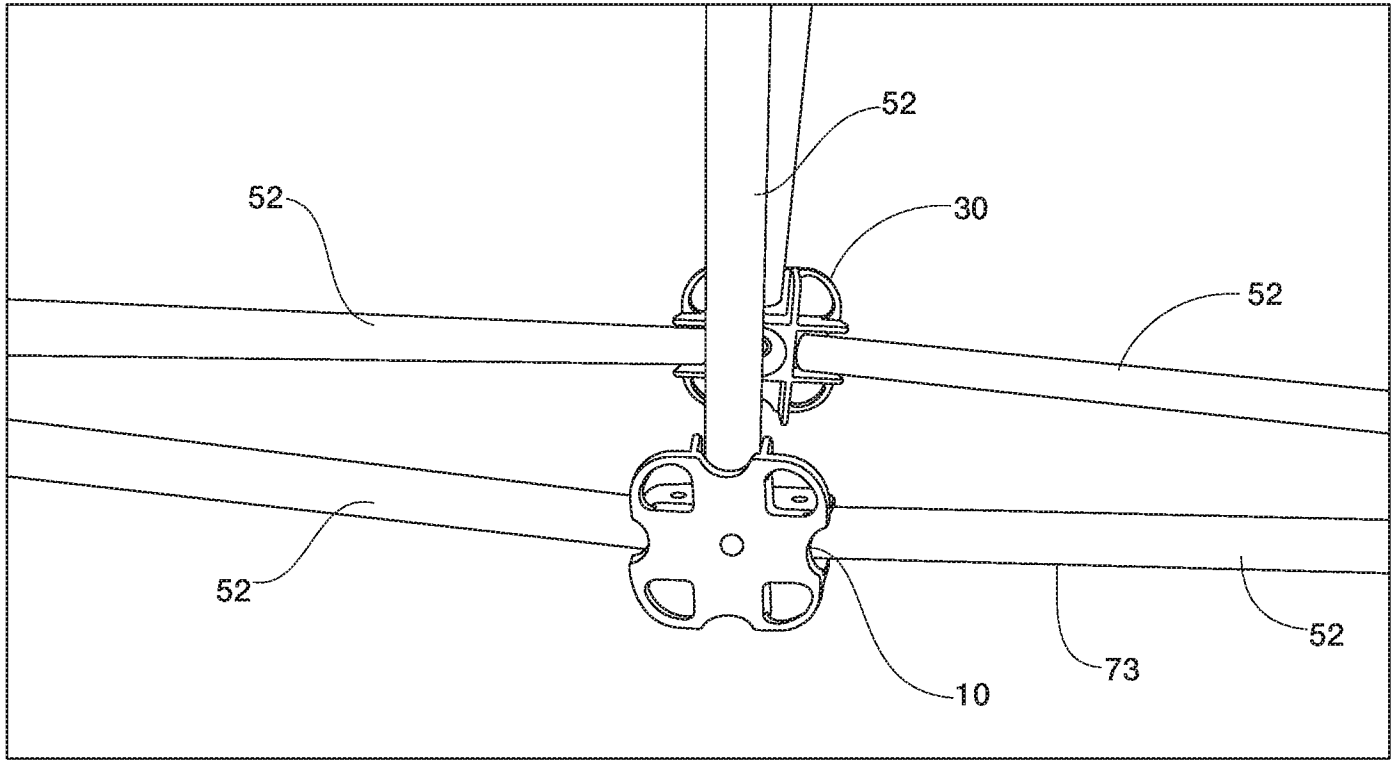
FIG. 12 is a close-up view of one example of a lower portion of the frame and hub assembly according to FIG. 10.
Figure 13:
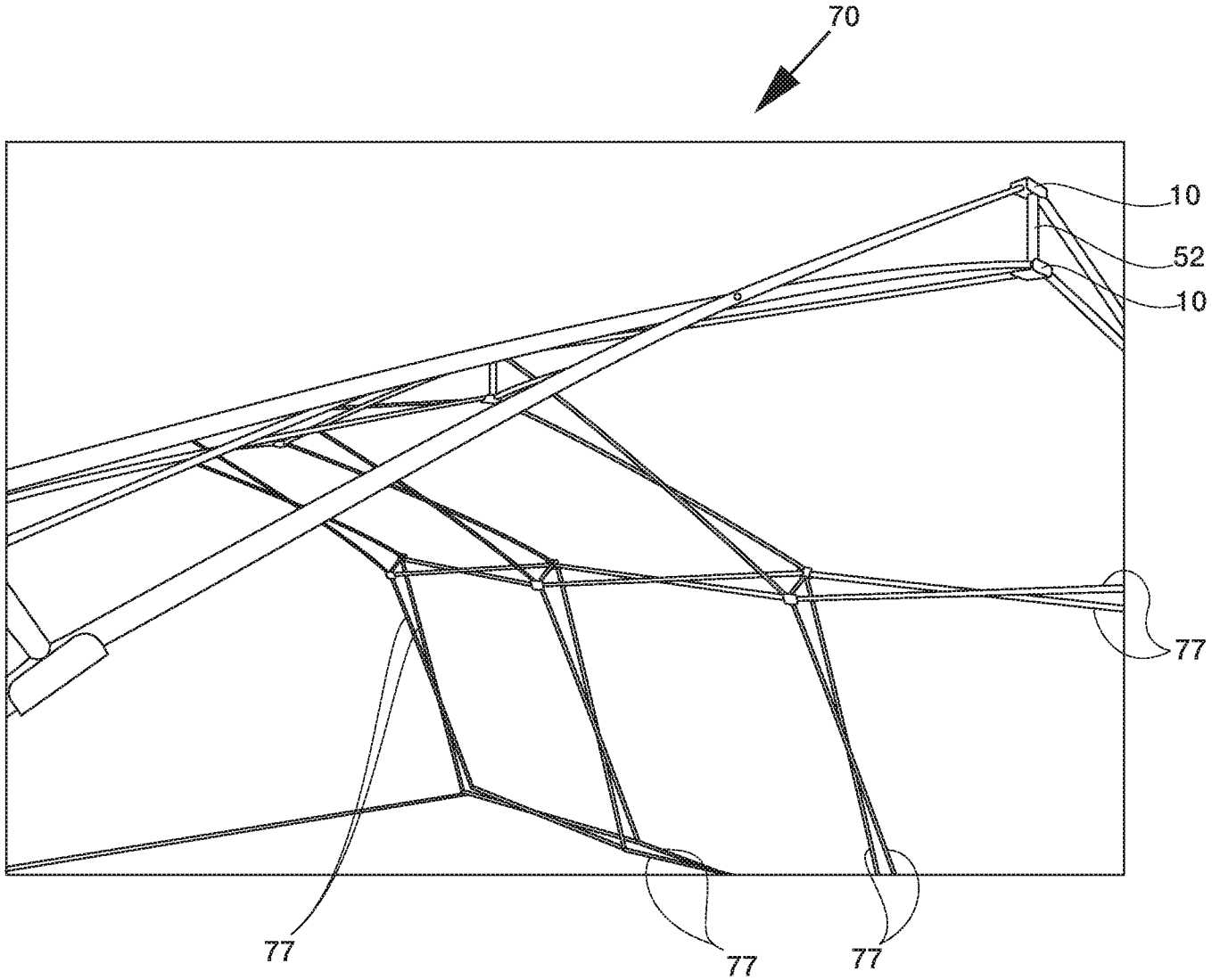
FIG. 13 is another opposite side perspective view of one example of the frame and hub assembly according to FIG. 10.
Figure 14:
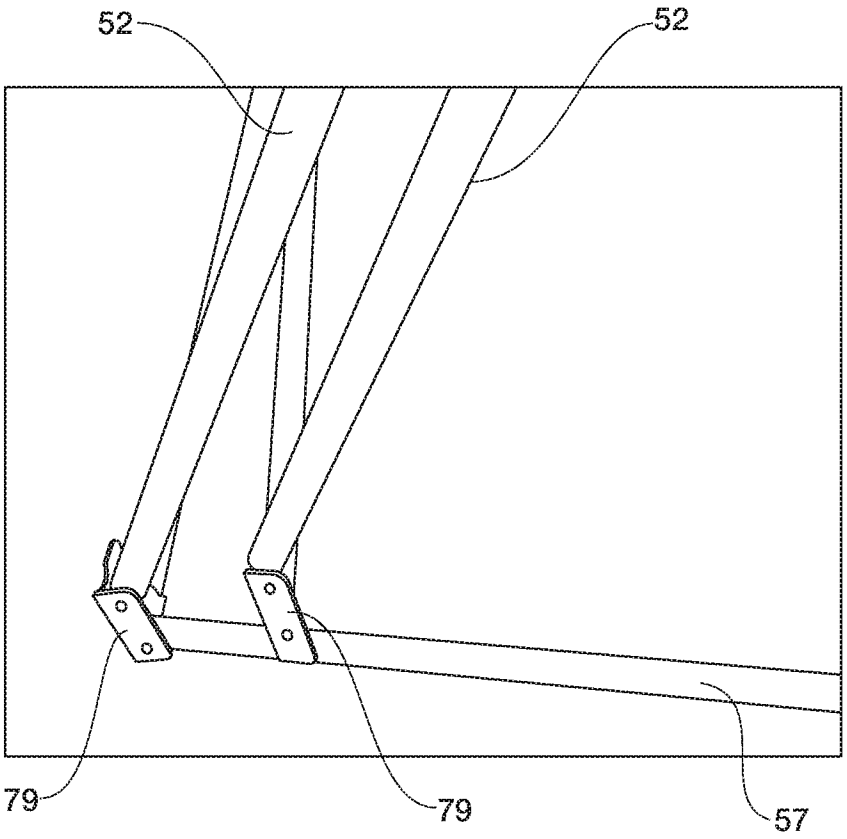
FIG. 14 is a close-up view of one example of a corner frame and hub assembly showing an example of a partial hub according to FIG. 10.

FIG. 12 shows a vertically aligned hub 10. Vertically aligned hubs 10 within the frame 72 may, as shown in FIG. 12, configure a space into the frame system and act as a spacer between two surfaces. The lower frame poles 52 in this example connect with a receiver slot 12 on a hub, thus the hub acting as a spacer to maintain a space between at least a portion of the lower frame poles 52 and the ground. In this instance, the space 73 is beneficial and allows portions of the canopy to wrap under the frame 70, and in some examples, without supporting weight.

Figure 15A:
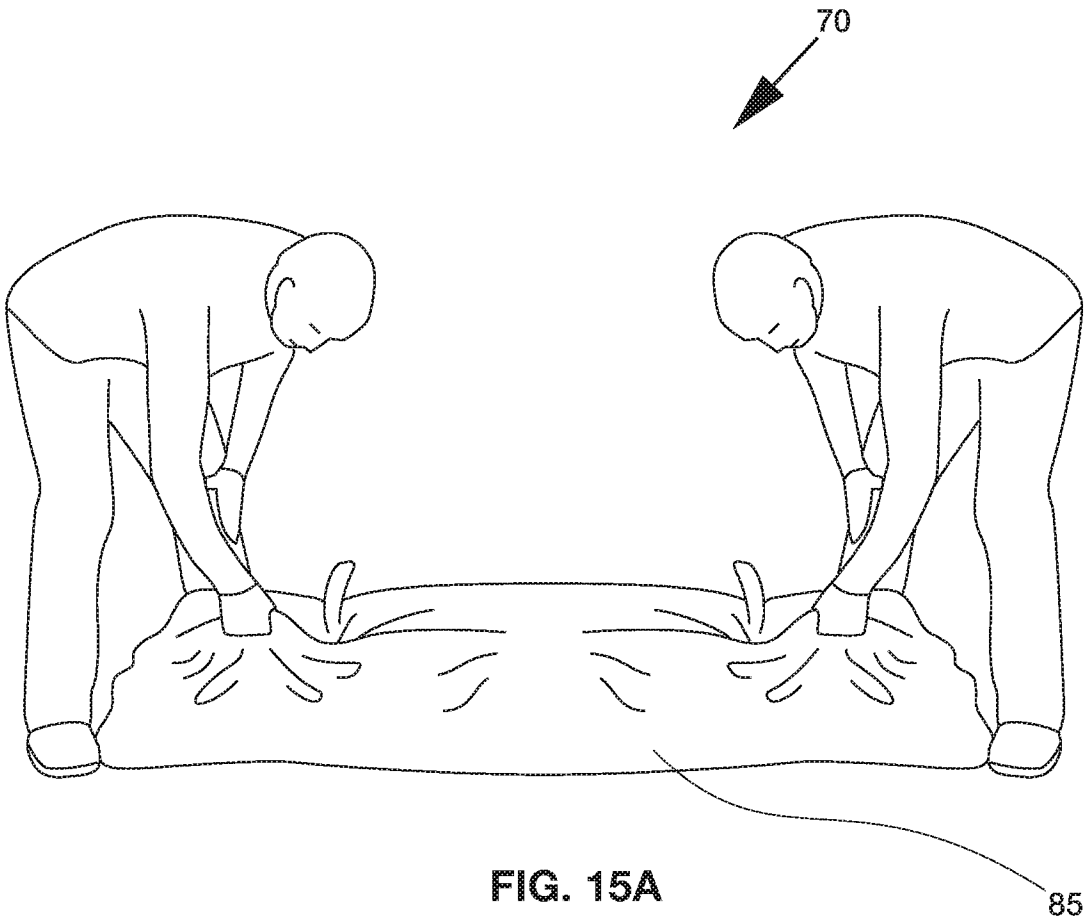
FIG. 15 A-G is perspective view of another example of a frame and hub assembly in a first deployed position and a second retracted position, according to the present disclosure.
Figure 15B:
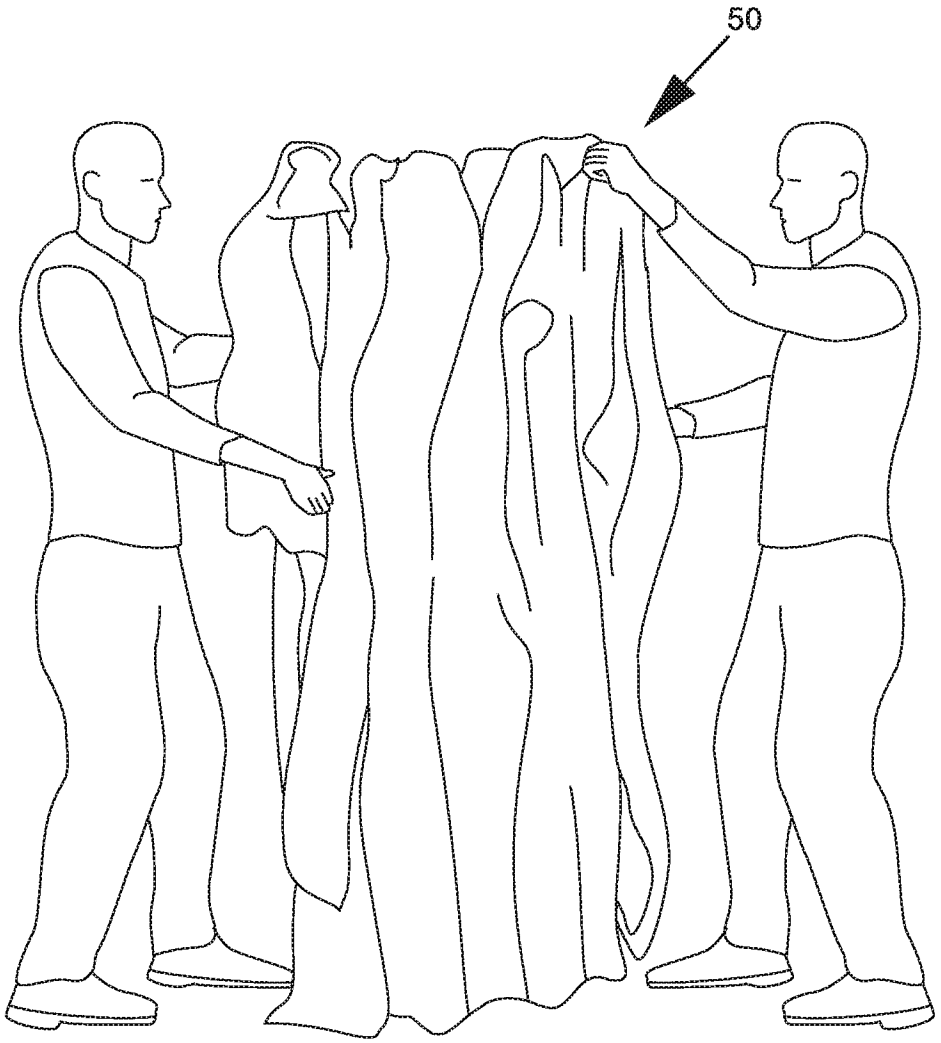
Figure 15C:
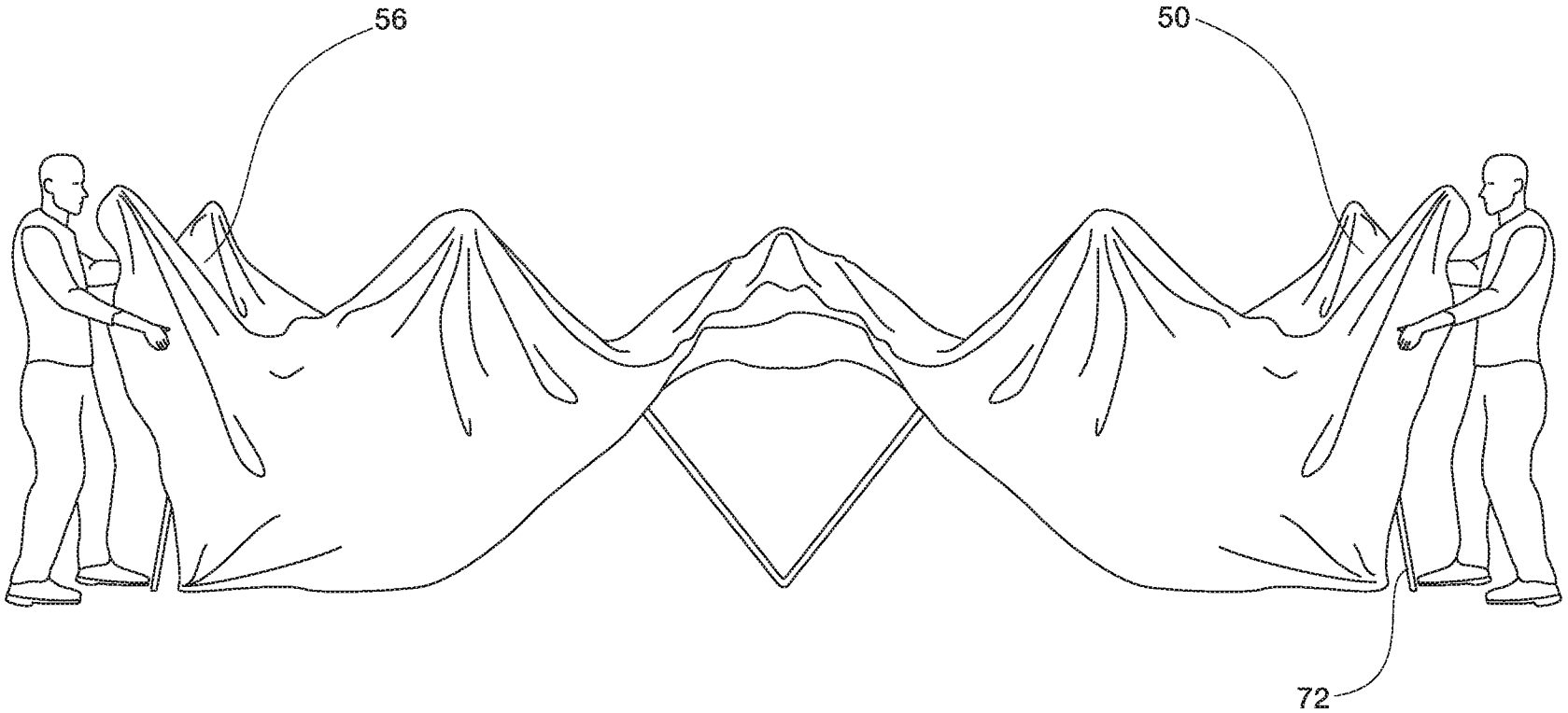
Figure 15D:
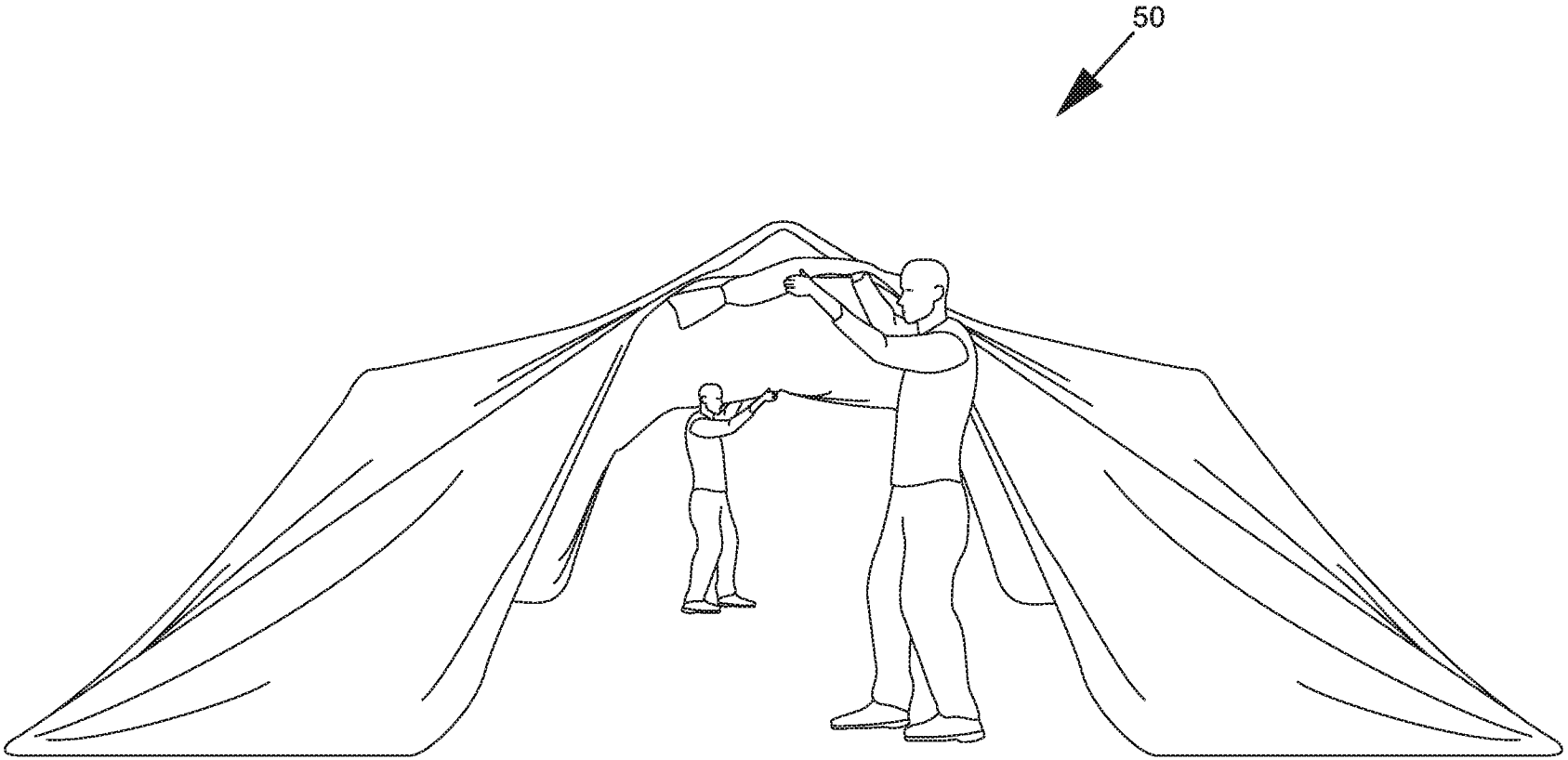
Figure 15E:
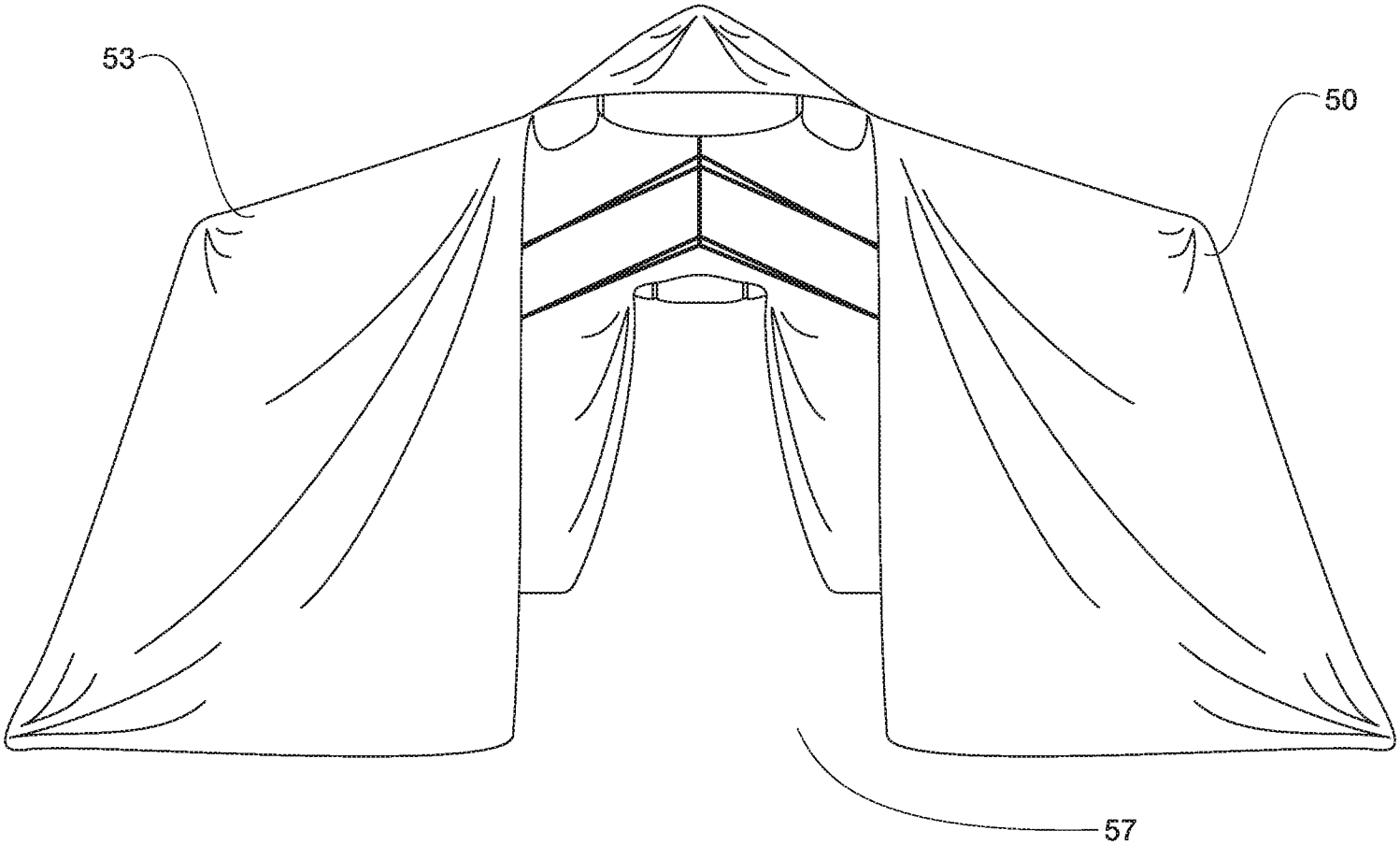
Figure 15F:
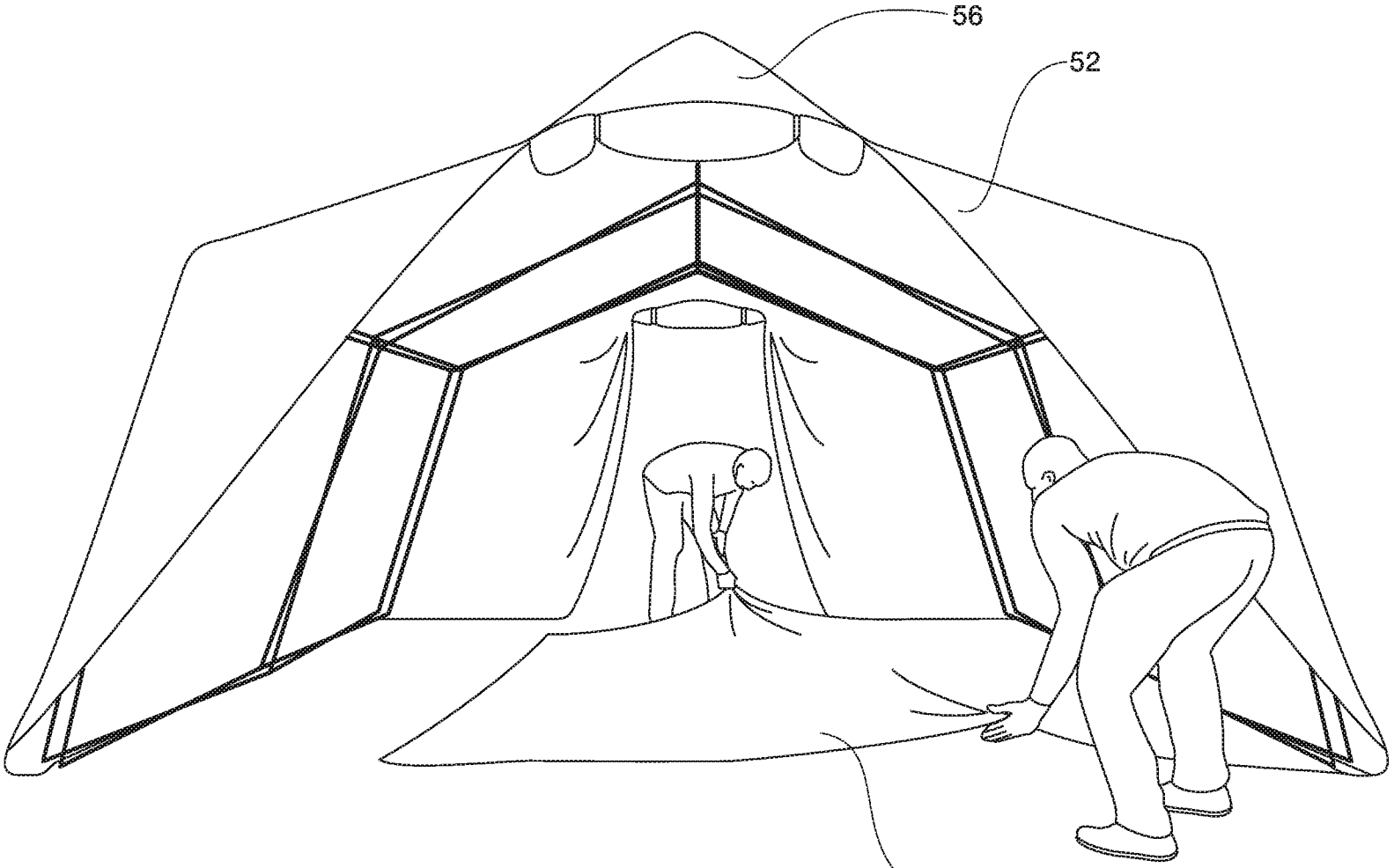
Figure 15G:
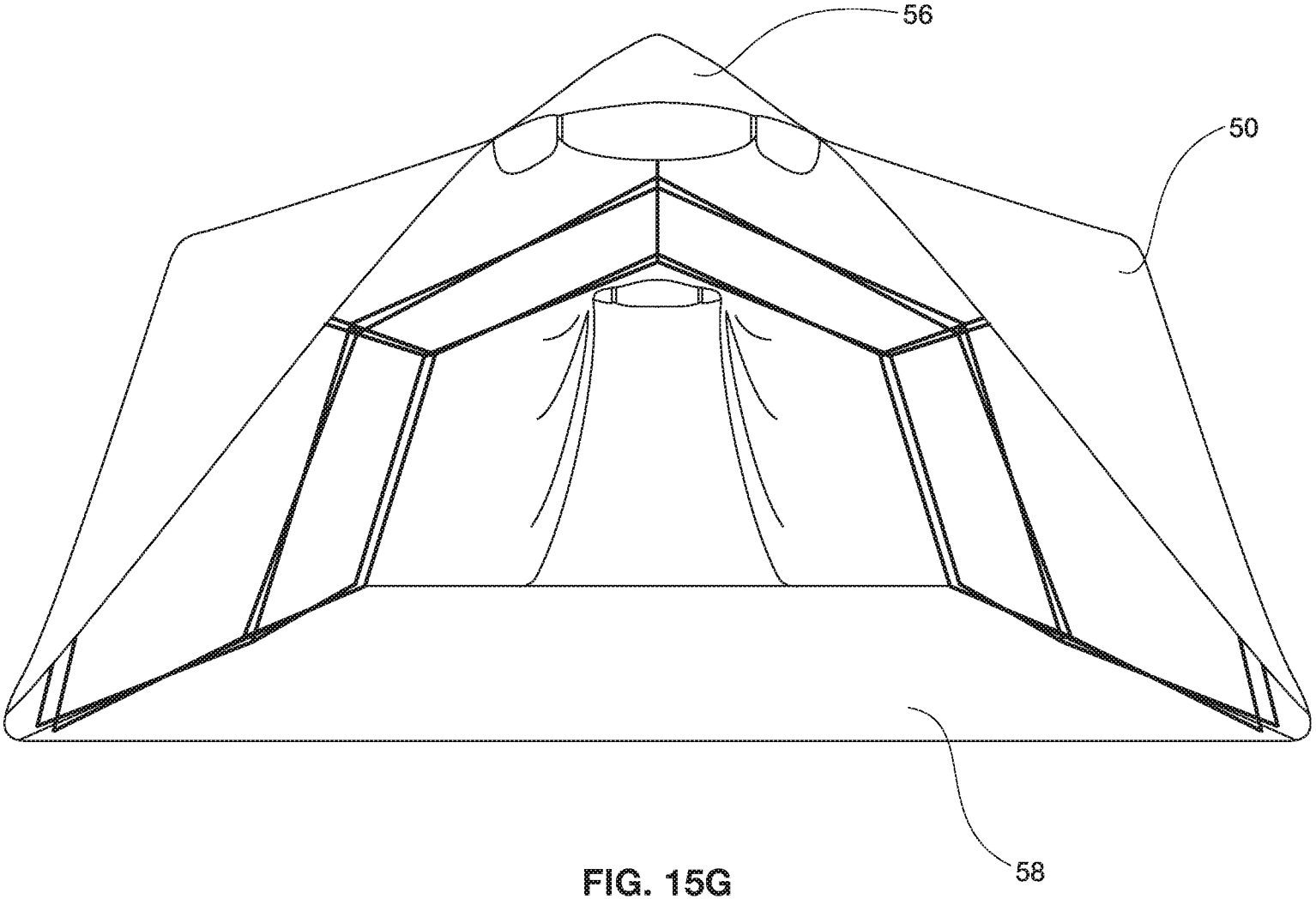

FIGS. 15A-G show a shelter system 70 in a retracted position (FIG. 15A). The shelter system may include a case 85. The case 85 may be a tough and durable material, for example, a vinyl material. The shelter may be encased in the cover for transport and storage. In use, the case is removed, and a liner may be included. In this example, the liner is removed. The shelter legs are bunched together in a substantially parallel position in the retracted position (FIG. 15B). A user may determine the door ends 59 and the wall ends 61 of the retracted shelter. A door end 59 will typically have at least 5 legs and the wall ends of the shelter typically have less than 5 legs. The shelter may be staged in its desired location. Expansion bars may be located within the frame, for example, top center bars of each wall, to be grasped and pulled apart, away from the retracted shelter on each wall end. The shelter may best, by way of example, move into the deployed position by raising the shelter slightly off the ground as the expansion bars are pulled outwardly as the articulating frame expands (FIG. 15C). The user lifts at the center point of each door end at the front and back of the shelter and the frame lifts into place, self-standing and fully deployed (FIG. 15D, 15G). A floor 58'/floor liner 58 may be added to the shelter or may be included (FIG. 15F). The floor may be aligned to meet the shelter canopy sides and ends. An insulation liner 65 may be attached at the projections 30. Other accessory items may be added to the system 70, by way of example, there may be an HVAC access panel in the canopy at which point an HVAC duct is placed and secured in order to attach to an HVAC system. In other examples, lighting, power, and supplies may also be added to the shelter system.

Figure 16A:
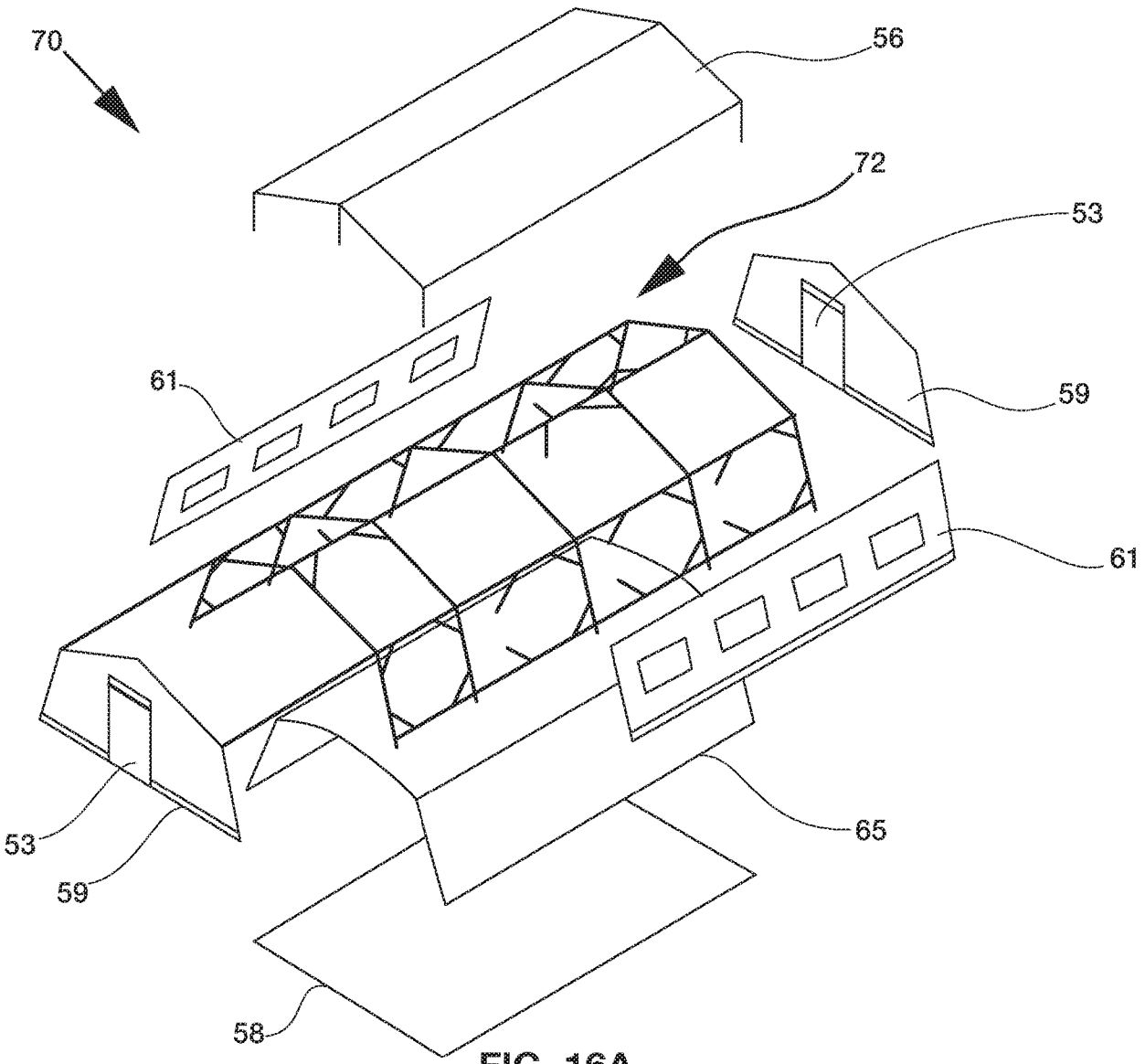
FIG. 16A-B are exploded views of one example of a shelter and shelter frame according to examples of the present disclosure.
Figure 16B:
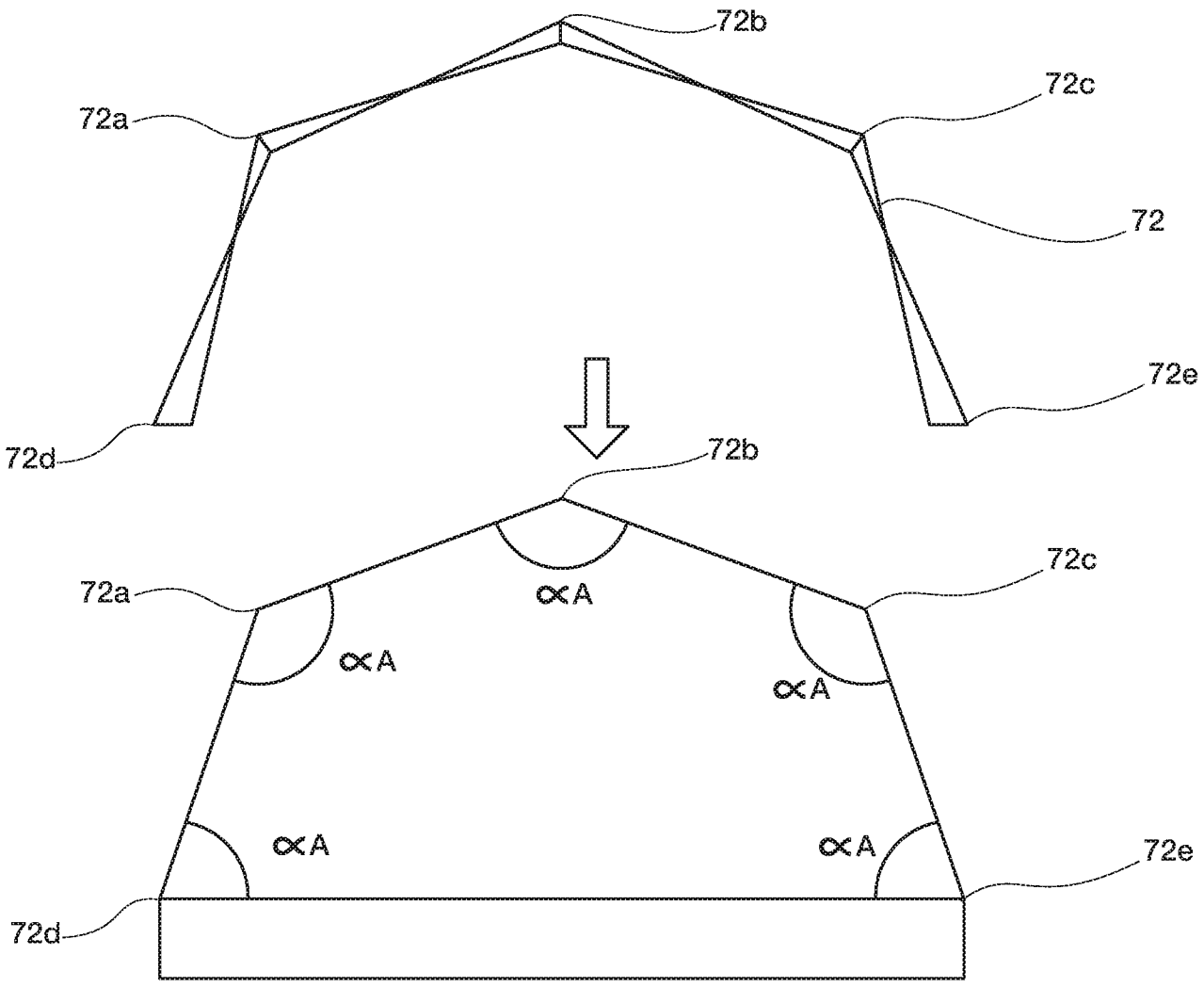
Figure 17:
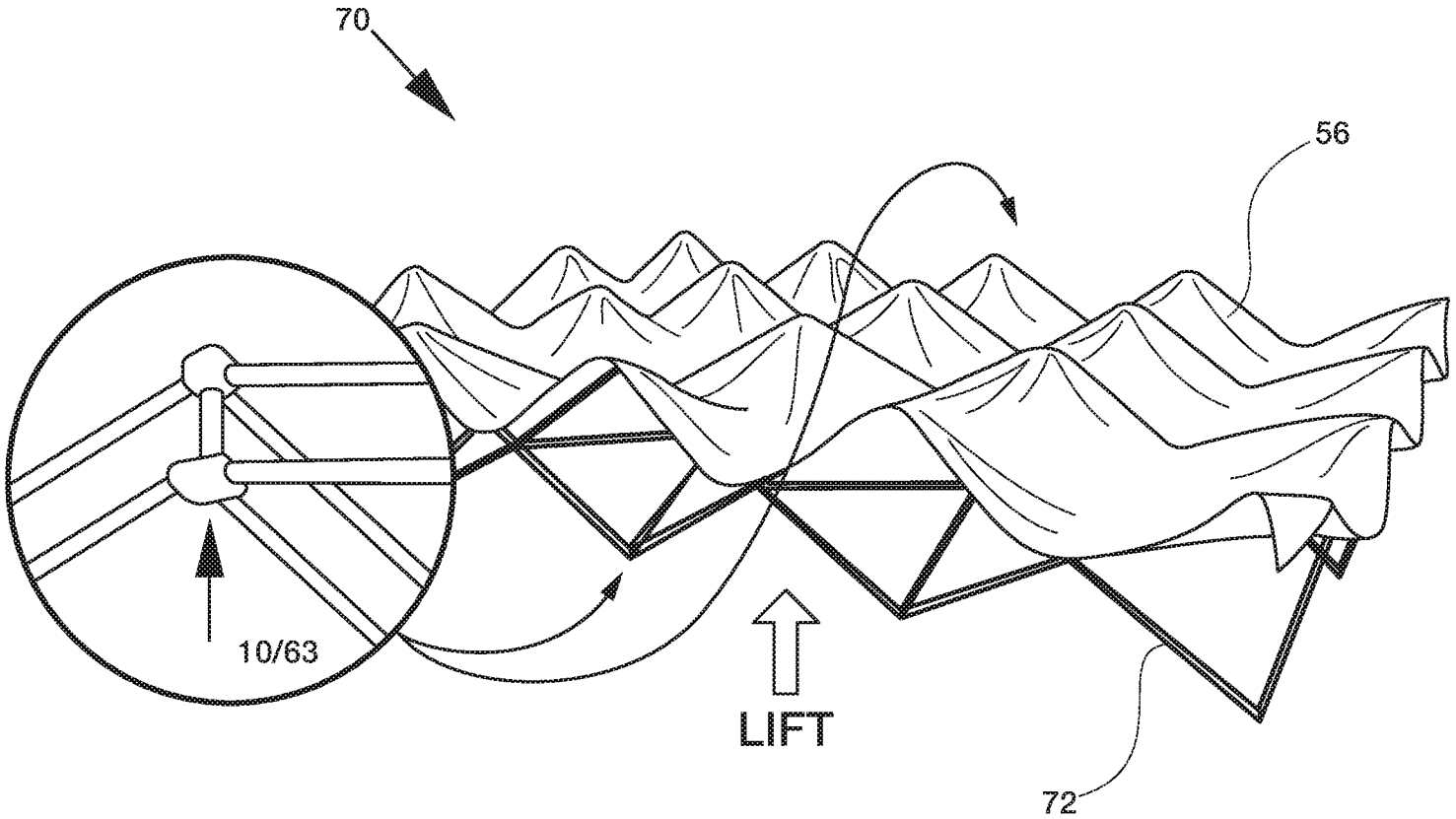
FIG. 17 is a perspective view of one example of a shelter including a hub.
Figure 18:
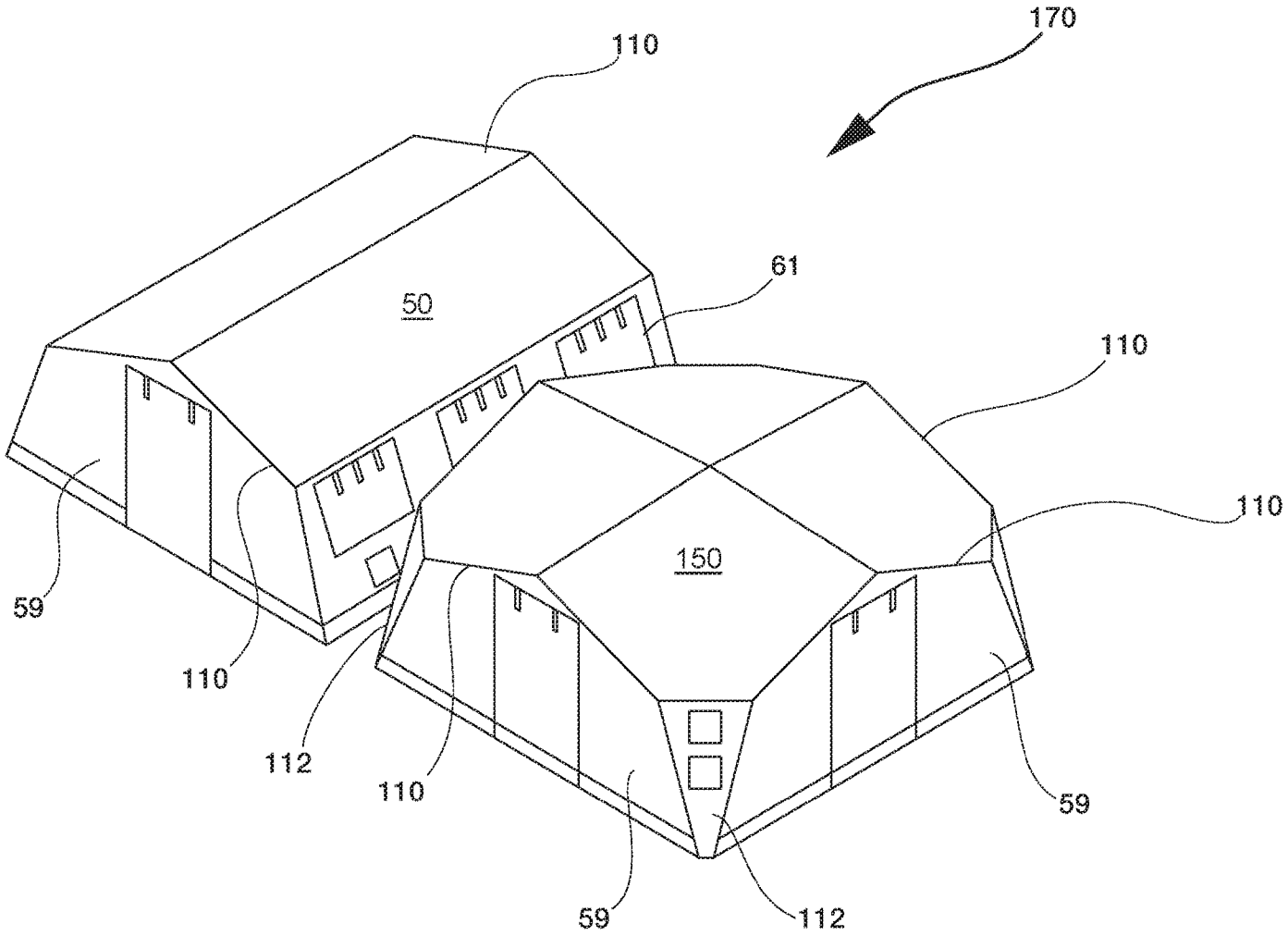
FIGS. 18-19 are perspective views of examples of a shelter system according to embodiments of the present disclosure.

In other embodiments, the inventions of the present disclosure may be considered a shelter and frame for an emergency, rapid-deployment shelter system 170. A shelter 50 may include a door end 59 including an arch framework, the frame 72 forming an arch frame end 110 at the door end 59. As seen in FIGS. 2, 16A, and 18, and exploded in FIG. 16B. The arched frame end 110 may include angles alphaA at the corners of the shelter. The angles alphaA may, in some examples include upper angles of greater than 90 degrees. In some examples, the alphaA angles in the upper angles of the shelter may between 90 degrees and 150 degrees. In some examples, the upper angles may more specifically be all above 125 degrees. Still, in other examples, the upper angle 72*b* may be greater than upper angles 72*a* and 72*c*. Upper angle 72*b* may be in some examples between 130 degrees and 145 degrees, and preferably in some examples between 135 and 140 degrees. Angles 72*a* and 72*c* may in some examples include an angle of between 125 degrees and 135 degrees, an in some examples preferably between 128 degrees and 132 degrees. Angles at legs 72*d* and 72*e* may be angles of less than angles 72*a* and 72*c*. In some embodiments, angles 72*d*, 72*e* may be between 65 degrees and 75 degrees, and more specifically in some examples, between 70 degrees and 74 degrees.

Figure 19:
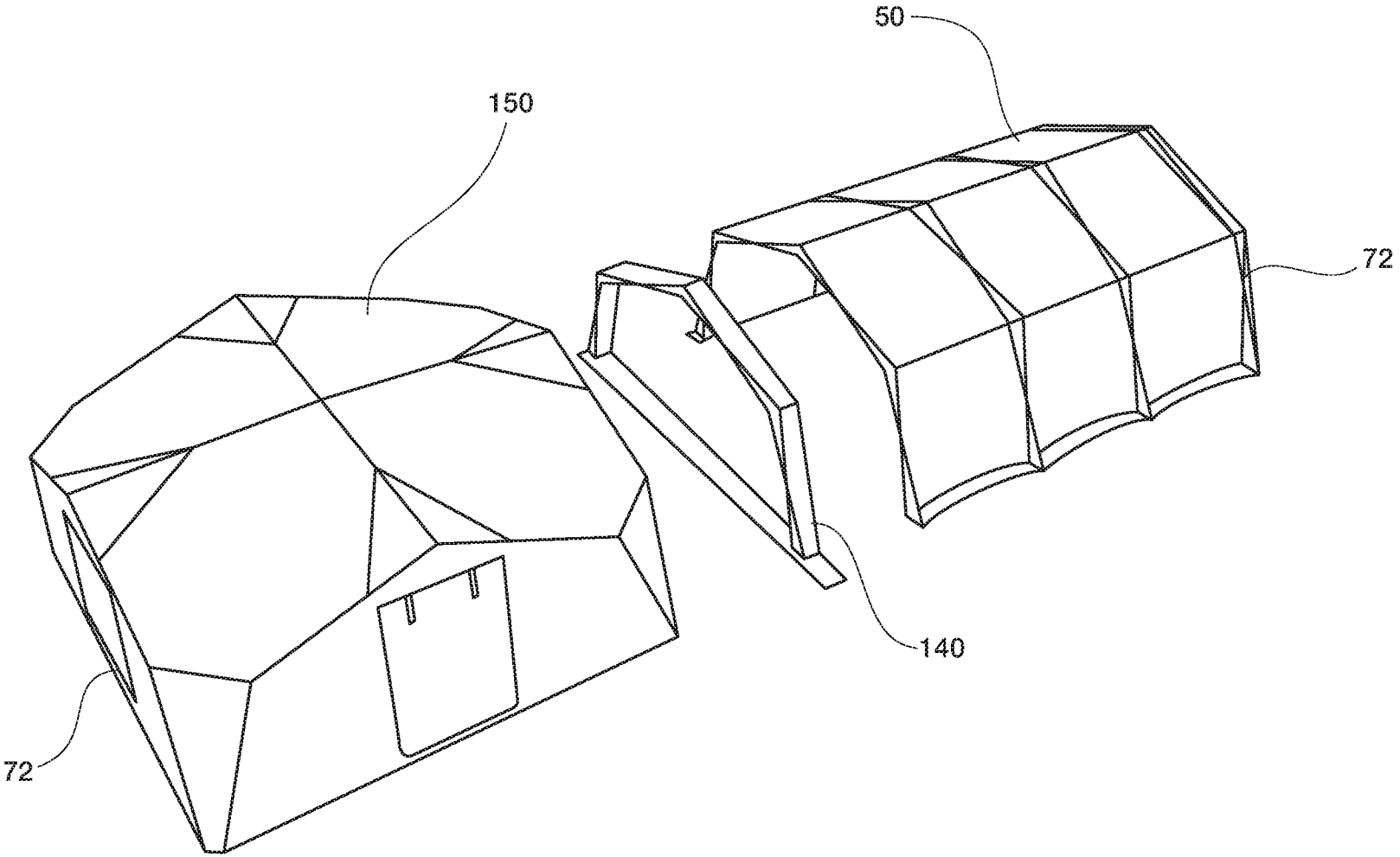
Figure 20A:
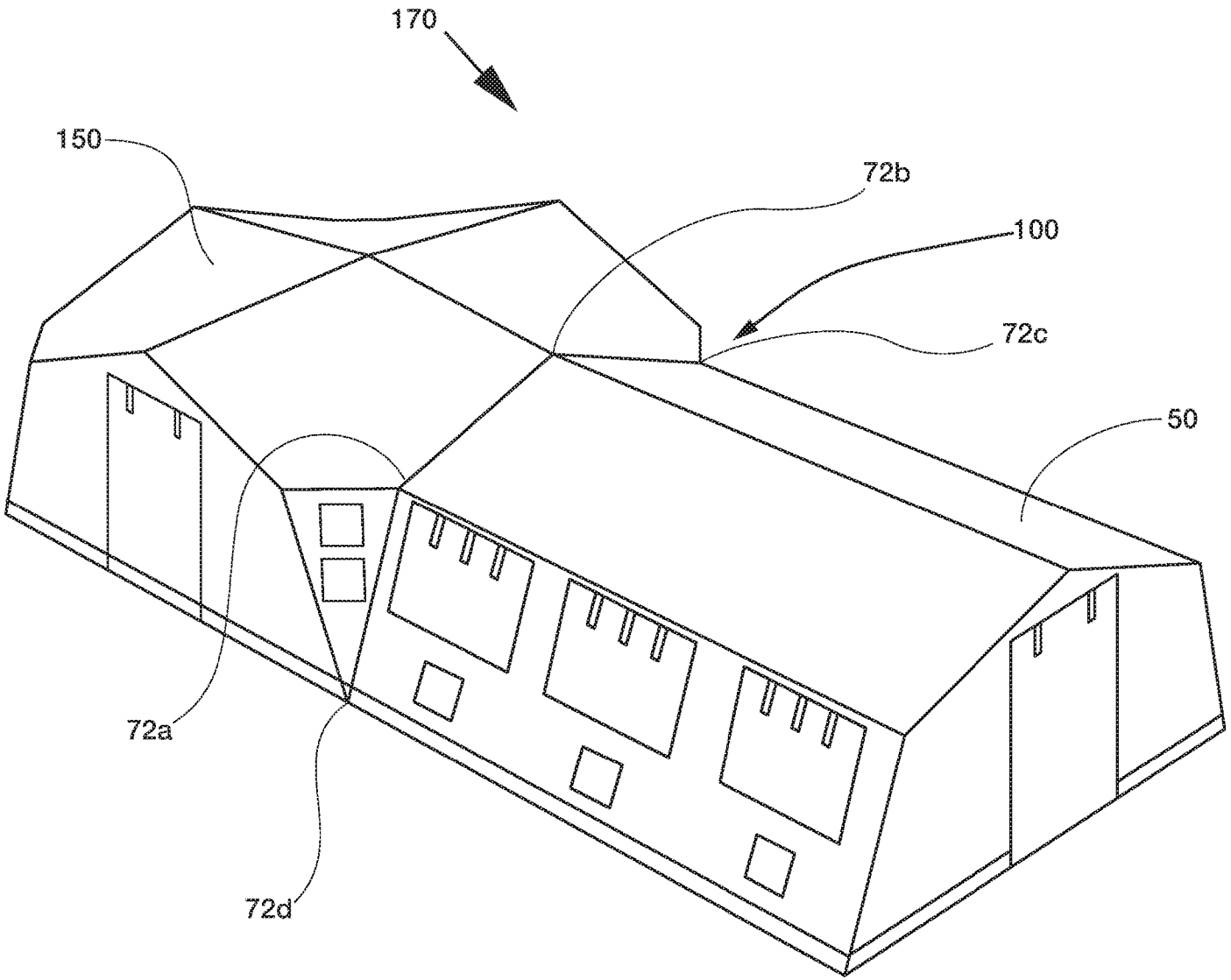
FIGS. 20A-D are perspective views of examples of shelters forming a shelter system according to embodiments of the present disclosure.
Figure 20B:
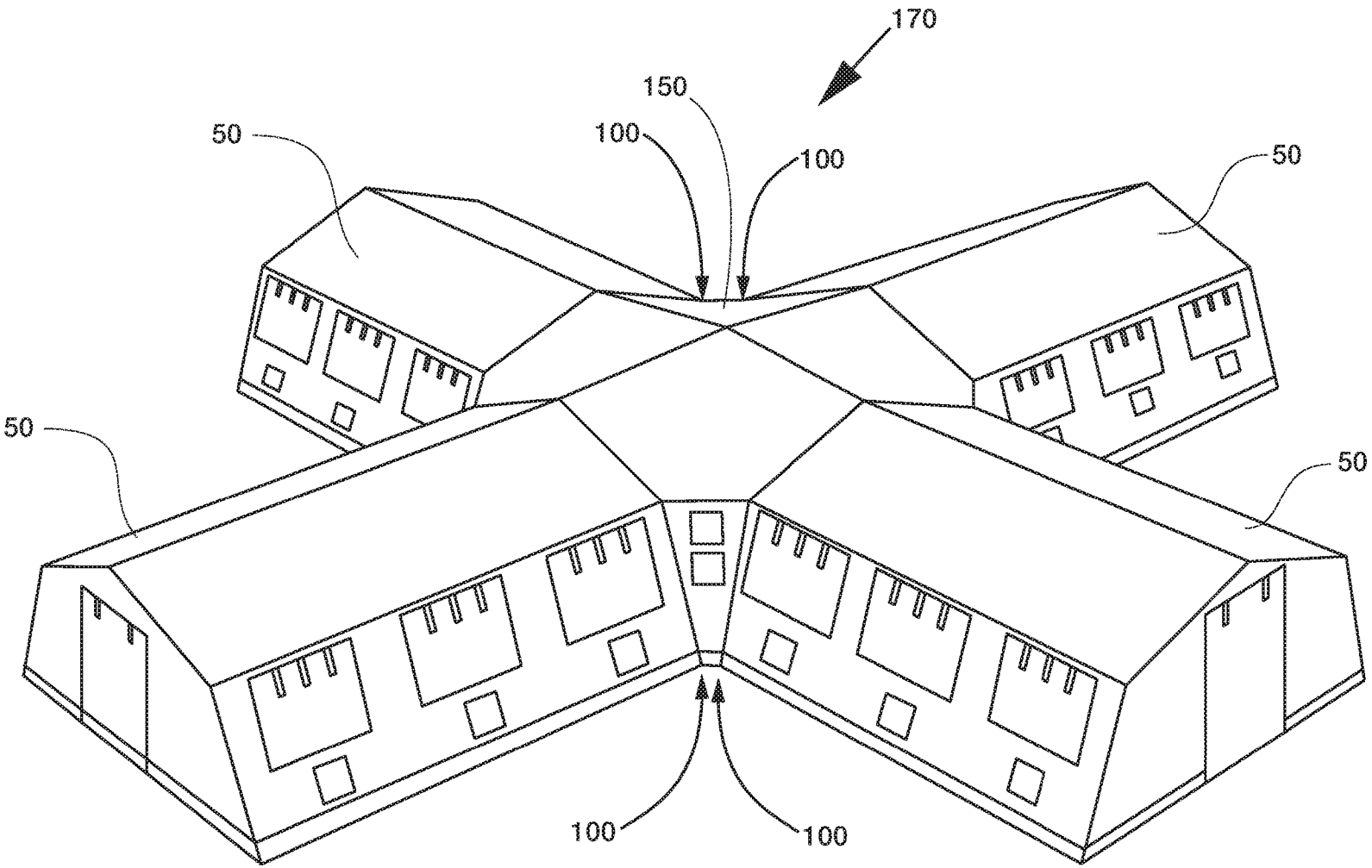
Figure 20C:
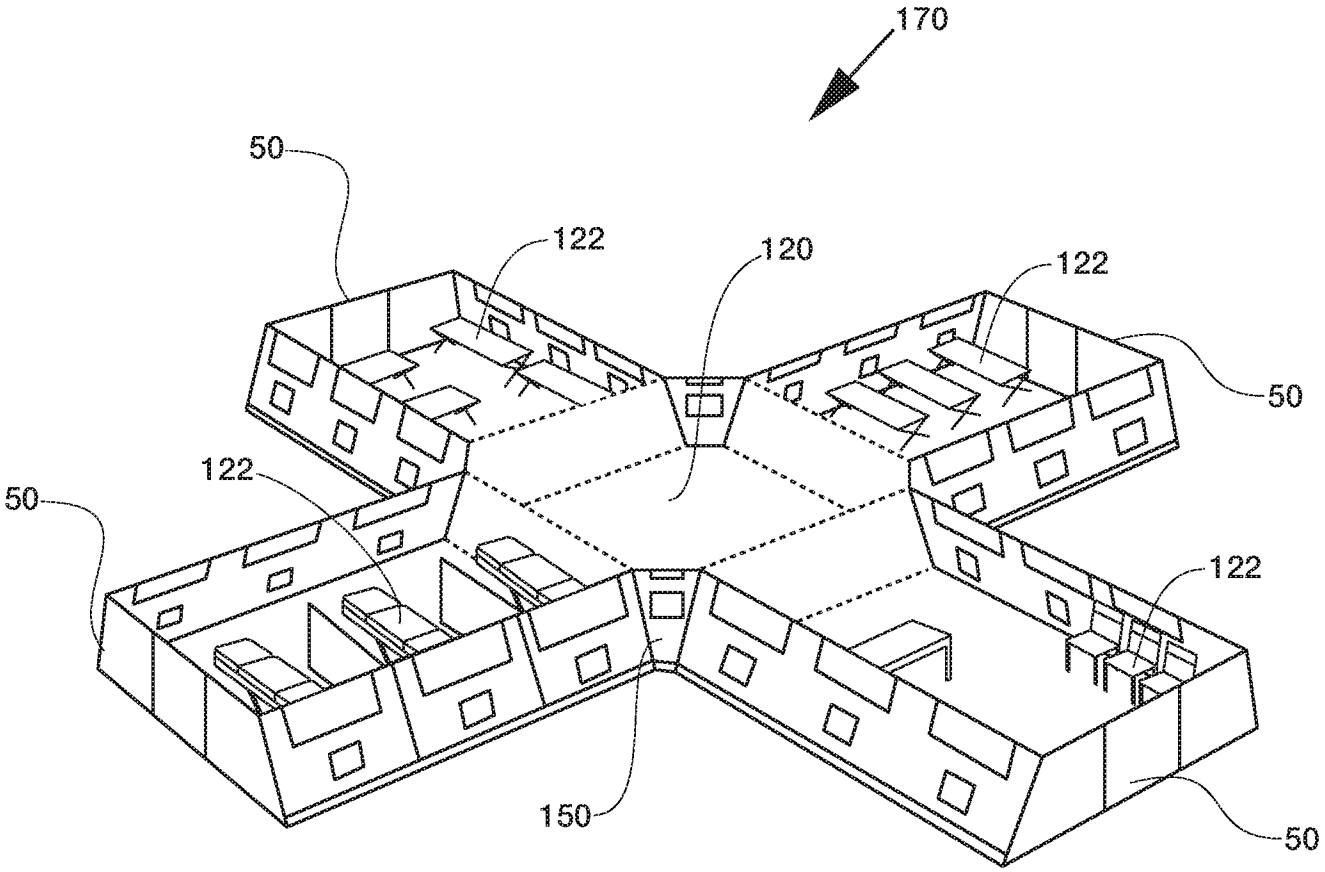
Figure 20D:
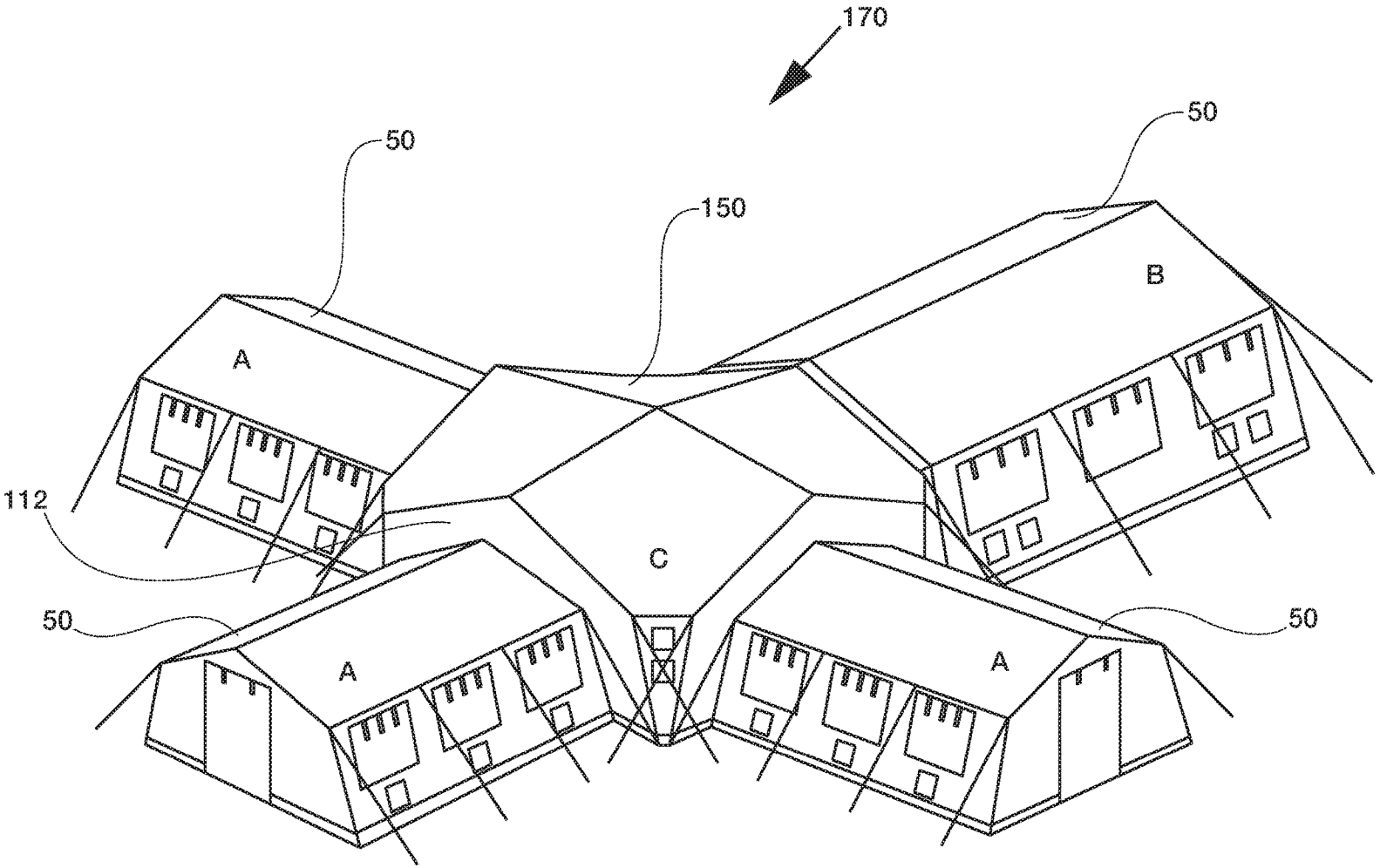

Shelters may be assembled door end 59 to door end 59 to form a scalable shelter complex. In this example, as shown in FIGS. 18 and 20A-D, one shelter having an arched frame end 110 may mate directly with another shelter having an arched frame end 110. In one embodiment, the two shelters, both including the arched frame ends may mate directly between the two arched frame ends 110, without requiring a vestibule or smaller opening structure between the two arched frame ends 110. A shelter attachment 140 may mimic the door end 59 frame dimension and fit with the adjoining shelters to direct a water flow away from the arched frame ends 110 where they connect, and direct it, as a gutter away from the shelter system, see FIG. 19. In some examples, the shelter attachment 140 may assist in making a substantially waterproof connection site between two adjoining shelters.

In other examples, a shelter may include more than one door end 59. A shelter with more than one door end 59 may, in some example be a hub shelter 150, allowing the attachment of more than one additional shelters, and in some cases up to four additional shelters for form a shelter system 170 adaptable as a shelter complex. The hub shelter 150 may include, in some embodiments two additional door ends 59 in place of the wall ends 61. As shown in FIGS. 20A-D this configuration allows the hub shelter 150 to adjoin with other shelters without a narrowing opening between the two shelters. The hub shelter 150 also is adaptable to accommodate at least four shelter attachments to the shelter hub 150. The shelter hub 150 may include four arched frame ends 110 that each mate with shelters having an arched frame end 110. The hub shelter 150 may include a larger surface area along the door end 59, while still mating an arched frame end 110 to the arched frame end 110 of the adjoining shelter 50. The hub shelter 150 may include other configurations of frame end openings, including a rounded opening by way of example and mate with an adjoining shelter 70 including a frame end opening with the same dimensions so that the two shelters 150, 70 mate without a narrowing in the opening between the two shelter frame end openings. The hub shelter may include corners 112. The corners 112 may project between the shelters 50 adjoining the shelter hub 150 at the frame end openings.

In other examples the inventions disclosed may be considered hub and shelter methods, for example a method for a hub, a method for a shelter system kit, a method for an improved shelter and a method for rapid deployment of a shelter according to the disclosure.

In yet another embodiment of the disclosure, included is a method for assembling a collapsed shelter 10 and securing the shelter 10 with a hub system according to any of the examples disclosed. In one example, the method may include carrying the shelter 10 collapsed, separating and/or unfolding the walls 12, expanding the shelter 10, aligning the frame of the shelter with a hub system to secure the shelter, e.g. including any of the embodiments previously shown or described. The method may also include attaching accessory items to an attachment projection 30 of a hub 10.

Portability of the shelter allows any of the shelter embodiments and examples shown and described herein to be transported to remote and difficult to reach locations, for instance because the hub and shelter components are lightweight to carry and collapsible. Often, in rapid deployment situations, shelters may be quickly set-up in a variety of environments, quickly taken-down and remain easily mobile.

Those of ordinary skill in the art having the benefit of this disclosure will recognize that any of the shelters and hub system described herein includes a variety of sizes, shapes, styles and support materials, all of which are considered within the scope of this disclosure.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A rapid-deployment shelter system, said shelter system comprising:

a shelter including a frame and a cover, wherein the frame is configured to alternate between a first extended angular opened position and a second retracted position;

the frame including sets of frame poles that are joined in pairs about an axis A at a connected point, the frame poles that are joined in pairs are configured to articulate relative to one another;

the frame in the angular opened position including: frame poles that are joined in pairs serving as leg poles, frame poles that are joined in pairs serving as ceiling poles, the leg poles each adjoining to ceiling poles and the ceiling poles adjoining with each other to form an upper angle at a peak;

wherein the joined leg poles and ceiling poles form an exterior frame opening configured to mate with an exterior frame opening of another shelter or a shelter attachment device; and wherein each side of the frame forms one said exterior frame opening.

2. The shelter system of claim 1, wherein the frame includes at least four exterior frame openings.

3. The shelter system of claim 1, wherein the shelter is a hub shelter.

4. The shelter system of claim 3, wherein the hub shelter is adapted to mate with a second shelter.

5. The shelter system of claim 4, wherein the hub shelter and the second shelter adjoin one with another to form a continuous interior space in a shelter complex.

6. The shelter system of claim 5, wherein the exterior frame openings include a set of upper angles and a set of lower angles.

7. The shelter system of claim 6, wherein the set of upper angles are each greater than the angles of each lower angle in the set of lower angles.

8. The shelter system of claim 3 wherein said hub shelter includes a shelter door end along each side of the shelter.

9. The shelter system of claim 1 wherein the frame at an exterior of the frame system is configured to fit with a frame of a second shelter to form a shared interior space through an angular mated opening.

10. The shelter system of claim 9 wherein each shelter includes a door end.

11. The shelter system of claim 9 including a shelter attachment device that fits along the face of the angular mated opening to form a connection between the adjoined shelters to avoid water penetration.

12. The shelter system of claim 11 wherein said shelter attachment is a geometric replica of the dimensions of the angular mated opening.

13. A rapid-deployment shelter system, the shelter system comprising:

an articulating frame system, said articulating frame system including a plurality of interconnected frame poles forming a frame, said articulating frame system configured to alternate between a first extended angular opened position and a second retracted position;

the frame including sets of frame poles that are joined in pairs about an axis A at a connected point, the frame poles that are joined in pairs are configured to articulate relative to one another;

the frame in the angular opened position including:

frame poles that are joined in pairs serving as leg poles, frame poles that are joined in pairs serving as ceiling poles, the leg poles each adjoining to ceiling poles and the ceiling poles adjoining with each other to form an upper angle at a peak;

a cover configured to fit with the frame to form a shelter, wherein the shelter is a hub shelter, and wherein each side of the articulating frame system is configured to fit with a frame of a second shelter to form a shared interior space through an angular mated opening.

14. The shelter system of claim 13 wherein the frame and the frame of the second shelter form a shelter complex with a shared interior space.

15. The shelter system of claim 14 including a hub that serves to connect items in the interior of the shelter.

16. The shelter system of claim 14 wherein the frame and the frame of the second shelter include door ends.

17. The shelter system of claim 16 including a shelter attachment that fits with the door ends of the shelter and second shelter.

* * * * *